US008115976B2

(12) United States Patent
Murakami

(10) Patent No.: US 8,115,976 B2
(45) Date of Patent: Feb. 14, 2012

(54) IMAGE FORMATION APPARATUS

(75) Inventor: Kakuji Murakami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1008 days.

(21) Appl. No.: 12/066,493

(22) PCT Filed: Jul. 24, 2007

(86) PCT No.: PCT/JP2007/064836

§ 371 (c)(1),
(2), (4) Date: Mar. 12, 2008

(87) PCT Pub. No.: WO2008/013297

PCT Pub. Date: Jan. 31, 2008

(65) Prior Publication Data

US 2009/0103147 A1 Apr. 23, 2009

(30) Foreign Application Priority Data

Jul. 28, 2006 (JP) ..... 2006-206659

(51) Int. Cl.
*H04N 1/04* (2006.01)

(52) U.S. Cl. ..... 358/498; 358/1.15; 358/501; 399/45; 399/82; 427/369; 156/230

(58) Field of Classification Search ..... 358/498, 358/474, 486, 497, 1.15, 501; 399/49, 390, 399/411, 67, 69, 323, 328, 45, 828, 84, 389; 427/198, 369, 271; 156/230, 234, 236
See application file for complete search history.

(56) References Cited

U.S. PATENT DOCUMENTS

| | | | | |
|---|---|---|---|---|
| 5,400,123 | A | 3/1995 | Sato et al. | |
| 5,593,937 | A * | 1/1997 | Saito et al. | 503/201 |
| 5,736,286 | A * | 4/1998 | Kaneko et al. | 430/124.15 |
| 5,781,822 | A * | 7/1998 | Nishiyama et al. | 399/1 |
| 5,782,254 | A * | 7/1998 | Tanikawa et al. | 134/109 |
| 5,968,301 | A * | 10/1999 | Murakami et al. | 156/230 |
| 6,055,070 | A * | 4/2000 | Kang | 358/497 |
| 6,236,831 | B1 * | 5/2001 | Mei et al. | 399/411 |
| 6,243,545 | B1 * | 6/2001 | Jewell | 399/67 |
| 6,489,039 | B2 * | 12/2002 | Yoshie | 428/530 |
| 6,832,055 | B2 * | 12/2004 | Ochiai | 399/1 |
| 7,099,603 | B2 * | 8/2006 | Kimura et al. | 399/82 |
| 7,283,758 | B2 * | 10/2007 | Murakami | 399/45 |
| 7,386,266 | B2 * | 6/2008 | Nagayama et al. | 399/341 |
| 7,773,270 | B2 * | 8/2010 | Haas et al. | 358/474 |
| 7,800,788 | B2 * | 9/2010 | Yazawa et al. | 358/474 |
| 7,880,935 | B2 * | 2/2011 | Maruta et al. | 358/404 |

(Continued)

FOREIGN PATENT DOCUMENTS

JP 4 67043 3/1992

(Continued)

*Primary Examiner* — Negussie Worku
(74) *Attorney, Agent, or Firm* — Oblon, Spivak, McClelland, Maier & Neustadt, L.L.P.

(57) ABSTRACT

A disclosed image formation apparatus includes: a manual paper feed unit supplying a recording material; an image formation unit receiving the recording material from the manual paper feed unit; an image removal device removing an image recorded on the recording material; an installation unit detachably installing the image removal device on the image formation apparatus; and a switching unit switching whether the recording material fed from the manual paper feed unit is supplied to the image removal device installed using the installation unit or to the image formation unit.

12 Claims, 16 Drawing Sheets

U.S. PATENT DOCUMENTS

| | | | | |
|---|---|---|---|---|
| 7,945,096 | B2 * | 5/2011 | Okada | 382/181 |
| 2002/0071687 | A1 * | 6/2002 | Matsuura et al. | 399/45 |
| 2004/0121254 | A1 * | 6/2004 | Nagayama et al. | 430/97 |
| 2004/0201871 | A1 * | 10/2004 | Risheq | 358/474 |
| 2005/0141906 | A1 | 6/2005 | Murakami | |
| 2006/0127152 | A1 * | 6/2006 | Nagayama et al. | 399/411 |
| 2006/0204302 | A1 | 9/2006 | Murakami | |
| 2009/0086276 | A1 * | 4/2009 | Tanaka | 358/401 |

FOREIGN PATENT DOCUMENTS

| | | |
|---|---|---|
| JP | 4 234056 | 8/1992 |
| JP | 6 89068 | 3/1994 |
| JP | 6-99644 | 4/1994 |
| JP | 7 56472 | 3/1995 |
| JP | 7-245668 | 9/1995 |
| JP | 8 152823 | 6/1996 |
| JP | 2584112 | 11/1996 |
| JP | 10 133522 | 5/1998 |
| JP | 10 171318 | 6/1998 |
| JP | 11 249511 | 9/1999 |
| JP | 3166449 | 3/2001 |
| JP | 2001 209284 | 8/2001 |
| JP | 2005 128046 | 5/2005 |
| JP | 2005 141172 | 6/2005 |

* cited by examiner

START
F1
SELECTION UNIT (KEY 91)IS ON ?
N
Y
ISSUE IMAGE FORMATION INSTRUCTION
F2
REUSABLE MEDIUM?
N
Y
F3
DRIVE DRIVING UNIT 223 AND MOVE GUIDE FLAP 222 TO CONVEYING POSITION
F5
ADD +1 TO COUNTER
F6
COUNT VALUE = PREDETERMINED TIMES?
Y
N
F4
PERFORM IMAGE FORMATION PROCESS ON REUSABLE MEDIUM
F7
STOP IMAGE FORMATION PROCESS ON REUSABLE MEDIUM
F8
ISSUE WARNING VIA WARNING UNIT
END

START

IMAGE REMOVAL PROCESS OPERATION IS BEING PERFORMED ON REUSABLE MEDIUM?
G1
N
Y
INSTRUCTION FOR IMAGE FORMATION OPERATION IS INPUT ?
G2
N
Y
COMPLETE IMAGE REMOVAL OPERATION
G3
CONTINUE IMAGE REMOVAL PROCESS OPERATION
G7
PERFORM IMAGE FORMATION PROCESS
G4
IMAGE FORMATION PROCESS IS ENDED?
G5
N
Y
RESUME IMAGE REMOVAL PROCESS OPERATION
G6
END

IMAGE FORMATION APPARATUS

TECHNICAL FIELD

The present invention relates to an image formation apparatus such as a copier, printer, facsimile machine, multi-function device, and more particularly to an image formation apparatus provided with a function of removing an image from a recording material where the image is formed after image information on the recording material is used.

BACKGROUND ART

With the spread of printers, analog copying machines, digital copying machines, printers, and the like employing electrophotography, ink-jet recording methods, and thermal transfer recording methods, a large amount of paper has been consumed. Paper generally used as recording materials is made from pulp gained from wood as recyclable resources. In a process for manufacturing paper, a lot of energy is consumed so as to extract cellulose fiber from wood in a pulping process and to dry paper in a papermaking step.

Although destructive lumbering for manufacturing paper has been reduced because of growing awareness of environmental issues, all paper is not made from wood logged from managed forests, so that it is an important social issue to prevent further deterioration of the global environment by protecting forests through control on paper consumption.

Further, because paper contains inorganic components which are noncombustible and imputrescible, when paper is disposed of, waste requiring landfilling is generated at a certain rate. However, it has become difficult to find waste landfill sites, so that the control on paper consumption is an important social issue also in this point of view.

In order to deal with these problems, in conventional methods, when paper on which information is recorded is no longer necessary, such paper is collected and dissolved into pulp at paper factories for recycling. Although these methods require no wood resources any further, substantially the same energy is consumed for transportation for collection, re-pulping, and re-papermaking as in a case where paper is manufactured from fresh pulp. Moreover, paper made from recycled pulp has quality problems such as reduced rigidity and whiteness, bleeding upon printing, and the like, so that a mix rate of recycled pulp in high-quality paper conventionally used as paper for recording information must be limited to about 30%. Further, upon collecting and recycling paper as recording materials on which information is recorded, paper on which information is recorded is circulated outside companies and outside homes which are uncontrolled areas, so that this poses problems in terms of confidentiality maintenance and privacy protection.

In recent years, management of information such as personal information has been strictly required, and it is desired that recording materials having information be not distributed outside each of information control areas including rooms, floors, divisions, buildings, offices, and the like.

As a method for resolving the above-mentioned problems, there have been proposed a method and a device for removing an image on a recording material that has been used so as to reuse the recording material. For example, as a method for removing a formed image on a recording material by transferring the image to an image peeling member, Patent Document 1 discloses a method and a device in which paper on which an image is formed by electrophotography is impregnated with liquid containing water, the paper and the image peeling member are brought into pressure contact in a heated status while adhesion between the paper to be used as a recording material and an image forming substance is reduced, and the image forming substance having thermoplasticity is separated and removed from the paper.

Patent Document 2 discloses a recording material having a mold release agent on a surface having a sheet-like shape, in which a mark is attached so as to discriminate from regular paper. Patent Document 3 discloses a device in which an endless belt having heat-melting resin on a surface thereof is used and an image formed on a recording material processed using release agent is separated and removed by thermal transfer. Patent Documents 4 and 5 disclose a method and a device in which an image on a recording material is removed by abrading and polishing the image using a grinding stone, a rubber roller, and the like so as to reuse the recording material on which the image is formed by electrophotography.

Other than the above-mentioned methods, there have been proposed various types of methods for removing or eliminating color of images. However, in any of these methods, applicable image forming substances, recording materials, image formation processes are limited when images are desired to be completely removed. Thus, when a recording material on which an image is formed by various types of image formation apparatuses is mixed in an image removal device, or various types of recording materials are mixed in the image removal device, depending on combinations other than specific combinations, levels of removal and color elimination of images are reduced, so that image information remaining after an image removal process may be readable or a number of times allowed for repeatedly using the recording materials may be reduced.

Patent Documents 5, 6, and 7 disclose examples of using the image formation apparatus and the image removal device integrally or in combination. In these Patent Documents, images are recorded on recording materials immediately after the image forming substances are removed by the image removal device from the recording materials.

As disclosed in these Patent Documents, by using the image formation apparatus and the image removal device integrally or in a connected manner, the necessity of setting again the recording materials in the image formation apparatus is eliminated. However, it is not possible to prevent mixing of recording materials other than those having an image formed by a specific image formation apparatus.

In Patent Document 8, the applicant proposed an image formation and removal system in which only a specific recording material on which an image is formed in a specific image formation process by a specific image formation apparatus is subjected to an image removal process, so that image forming substances on the recording material are securely removed and it is possible to prevent generation of jam and the like resulting from failure of separation of the recording material and an image peeling member which may be occurred in a process for removing the image forming substances.

However, even when the image formation apparatus and the image removal device are integrated, few proposal to sufficiently utilize characteristics of the integrated image formation apparatus and the image removal device has been made.

Patent Document 1: Japanese Laid-Open Patent Application No. 7-56472

Patent Document 2: Japanese Laid-Open Patent Application No. 4-67043

Patent Document 3: Japanese Laid-Open Patent Application No. 4-64472

Patent Document 4: Japanese Laid-Open Patent Application No. 4-234056

Patent Document 5: Japanese Laid-Open Patent Application No. 6-89068

Patent Document 6: Japanese Laid-Open Patent Application No. 10-171318

Patent Document 7: Japanese Laid-Open Patent Application No. 7-175384

Patent Document 8: Japanese Laid-Open Patent Application No. 2005-128046

DISCLOSURE OF INVENTION

It is a general object of the present invention to provide an improved and useful image formation apparatus in which the above-mentioned problems are eliminated.

A more specific object of the present invention is to provide an image formation apparatus that has a reduced number of components, reduced environmental load, and is capable of removing images at low cost. Paper conventionally used for image formation is commercially available at a relatively low price, so that when an image removal function is provided to the image formation apparatus, by reusing a recording material, preferably, a cost becomes lower than purchasing new paper. Thus, the image formation apparatus to which the image removal function is provided is required to have a practical functionality and a simple structure.

Another specific object of the present invention is to provide an image formation apparatus capable of quickly removing image information before such information is read by someone who is not supposed to know. In other words, another specific object of the present invention is to provide a function of removing important confidential information from the recording material preferentially over other information and making it possible to confirm the removal of the confidential information recorded on the recording material.

Another specific object of the present invention is to reduce defects generated when an image formation apparatus and an image removal device are integrated or when both devices are combined as a unit. In other words, another specific object of the present invention is to prevent consumption of excessive electric power resulting from operation of both devices at the same time. In order to obtain merits generated when the image formation apparatus and the image removal device are integrated or when both devices are combined as a unit, functions common to both devices are preferably obtained by operating parts common to both devices as much as possible so as to simplify structures of both devices. In view of this, another specific object of the present invention is to prevent generation of trouble upon performing functions using the common parts and obtain functions preferable for users.

Another specific object of the present invention is to prevent generation of trouble such as residual images remaining after an image removal process, generation of jam, and the like.

Another specific object of the present invention is to provide an image formation apparatus detachably including an image removal device in accordance with user preference.

According to one aspect of the present invention, there is provided an image formation apparatus comprising: a manual paper feed unit supplying a recording material; an image formation unit receiving the recording material from the manual paper feed unit; an image removal device removing an image recorded on the recording material; an installation unit detachably installing the image removal device on the image formation apparatus; and a switching unit switching whether the recording material fed from the manual paper feed unit is supplied to the image removal device installed using the installation unit or to the image formation-unit.

According to another aspect of the present invention, there is provided an image formation apparatus comprising: a manual paper feed unit supplying a recording material; an image formation unit receiving the recording material from the manual paper feed unit; an image removal device disposed on the image formation apparatus, the image removal device removing an image recorded on the recording material; and a switching unit switching whether the recording material fed from the manual paper feed unit is supplied to the image removal device or to the image formation unit.

According to another aspect of the present invention, in the image formation apparatus, the recording material includes a reusable medium from which a formed image is removed by the image removal device and a general recording material which is not supplied to the image removal device and has a formed image that is not removed.

According to another aspect of the present invention, in the image formation apparatus, the reusable medium includes a recording material to which at least one agent having repellency to image forming substance is provided so as to reduce fixation on an image forming substance.

According to another aspect of the present invention, the image formation apparatus includes: a first paper feed cassette storing the reusable medium; and a second paper feed cassette storing the general recording material.

According to another aspect of the present invention, the image formation apparatus includes: a selection unit allowing a user to select a first image formation mode for forming an image on the reusable medium and a second image formation mode for forming an image on the general recording material; and a control unit performing control so as to form an image on the reusable medium when the first image formation mode is selected and to form an image on the general recording material when the second image formation mode is selected using the selection unit.

According to another aspect of the present invention, in the image formation apparatus, the reusable medium has discrimination information for recognizing reusability of the reusable medium, a first conveying path for supplying the recording material to the image formation unit and a second conveying path for supplying the recording material to the image removal device partially share a common path for conveying the recording material, and a recognition unit judging the discrimination information of the reusable medium is disposed on the common path for conveying the recording material.

According to another aspect of the present invention, in the image formation apparatus, an image is formed in the image formation unit when a recording material appropriate for an image formation mode is detected before recording materials inappropriate for the image formation mode selected using the selection unit are successively detected for a predetermined number of times, an image formation operation by the image formation unit is stopped when inappropriate recording materials are successively detected for the predetermined number of times, and ejection is performed without performing the image formation operation when inappropriate recording materials are successively detected for less than the predetermined number of times.

According to another aspect of the present invention, the image formation apparatus includes: a warning unit outputting warning information for notifying that an inappropriate recording material is set when inappropriate recording materials are successively detected by the recognition unit for a predetermined number of times.

According to another aspect of the present invention, in the image formation apparatus, the discrimination information in the reusable medium includes discrimination information recorded in an IC chip disposed on the reusable medium in an integrated manner.

According to another aspect of the present invention, in the image formation apparatus, after the image removal device is installed on the image formation apparatus, even when an image removal process operation is being performed successively by the image removal device, if an image formation instruction is input, the image removal process operation is suspended and an image formation operation is preferentially performed, and then after the image formation operation is ended, the image removal process operation is resumed.

According to another aspect of the present invention, in the image formation apparatus, after the image removal device is installed on the image formation apparatus, even when an image removal process operation is being performed on a recording material by the image removal device, the recording material being conveyed from a paper feed cassette disposed on the image formation apparatus or the image removal device, if an image removal process instruction is input for a recording material supplied from the manual paper feed unit, the image removal process operation on the recording material conveyed from the paper feed cassette is suspended and an image removal process operation on the recording material conveyed from the manual paper feed unit is preferentially performed, and then after the image removal process operation is ended, the image removal process operation on the recording material conveyed from the paper feed cassette is successively resumed.

According to another aspect of the present invention, the image formation apparatus includes: a control unit performing an interrupt control, wherein after the image removal device is installed on the image formation apparatus, even when an image formation operation is being performed successively or an image removal process operation is being performed successively on a recording material by the image removal device, the recording material being conveyed from a paper feed cassette disposed on the image formation apparatus or the image removal device, if an image removal process instruction is input for a recording material supplied from the manual paper feed unit, the image formation operation or the image removal process operation on the recording material conveyed from the paper feed cassette is temporarily suspended and an image removal process operation on the recording material conveyed from the manual paper feed unit is preferentially performed, and then after the image removal process operation is ended, the suspended image formation operation or the image removal process operation on the recording material conveyed from the paper feed cassette is resumed.

According to another aspect of the present invention, in the image formation apparatus, even when an image removal process operation is being performed successively by the image removal device, if an image formation instruction is input, the image removal process operation is suspended and an image formation operation is preferentially performed, and then after the image formation operation is ended, the image removal process operation is resumed.

According to another aspect of the present invention, in the image formation apparatus, even when an image removal process operation is being performed on a recording material by the image removal device, the recording material being conveyed from a paper feed cassette disposed on the image formation apparatus or the image removal device, if an image removal process instruction is input for a recording material supplied from the manual paper feed unit, the image removal process operation on the recording material conveyed from the paper feed cassette is suspended and an image removal process operation on the recording material conveyed from the manual paper feed unit is preferentially performed, and then after the image removal process operation is ended, the image removal process operation on the recording material conveyed from the paper feed cassette is successively resumed.

According to another aspect of the present invention, the image formation apparatus includes: a control unit performing an interrupt control, wherein even when an image formation operation is being performed successively or an image removal process operation is being performed successively on a recording material by the image removal device, the recording material being conveyed from a paper feed cassette disposed on the image formation apparatus or the image removal device, if an image removal process instruction is input for a recording material supplied from the manual paper feed unit, the image formation operation or the image removal process operation on the recording material conveyed from the paper feed cassette is temporarily suspended and an image removal process operation on the recording material conveyed from the manual paper feed unit is preferentially performed, and then after the image removal process operation is ended, the suspended image formation operation or the image removal process operation on the recording material conveyed from the paper feed cassette is resumed.

According to the present invention, the image removal device is configured to be detachably installed. When the image removal device is installed using the installation unit, the recording material on which an image is formed is supplied via the switching unit to the image removal device from the manual paper feed unit included in the image formation apparatus. Thus, it is possible to provide the image removal device added as an optional device at low cost and having a simple structure. Further, it is possible to perform the image removal process on the recording material where highly-confidential image information is formed through an interrupt control using the manual paper feed unit employed for image formation.

According to the present invention, the image formation apparatus comprises: the manual paper feed unit supplying the recording material; the image formation unit receiving the recording material from the manual paper feed unit; the image removal device removing an image recorded on the recording material; the installation unit detachably installing the image removal device on the image formation apparatus; and the switching unit switching whether the recording material fed from the manual paper feed unit is supplied to the image removal device installed using the installation unit or to the image formation unit. Thus, it is possible to perform the image removal process on the recording material where highly-confidential image information is formed through an interrupt control using the manual paper feed unit employed for image formation.

According to the present invention, a reusable medium includes a recording material to which at least one agent having repellency to image forming substance is provided so as to reduce fixation on an image forming substance. Thus, it is possible to form an image on the reusable medium when image information formed on the recording material is used only for a short period of time and to form an image on general recording material in other cases. And, it is possible to provide a system including an image formation function and an image removal function with a simple structure at low cost and reduced environmental load along with effects mentioned above.

According to the present invention, the image formation apparatus includes: the first paper feed cassette storing the reusable medium; and the second paper feed cassette storing the general recording material. Thus, it is possible to form an image on the reusable medium when image information formed on the recording material is used only for a short period of time and to form an image on general recording material in other cases. And, it is possible to provide a system including an image formation function and an image removal function with a simple structure at low cost and reduced environmental load along with effects mentioned above.

According to the present invention, the image formation apparatus includes: the selection unit allowing a user to select a first image formation mode for forming an image on the reusable medium and a second image formation mode for forming an image on the general recording material; and the control unit performing control so as to form an image on the reusable medium when the first image formation mode is selected and to form an image on the general recording material when the second image formation mode is selected using the selection unit. Thus, when the user is assumed in advance to use image information formed on the recording material only for a short period of time, it is possible to form an image on the reusable medium securely capable of being subjected to the image removal process so as to reduce environmental load and to provide a system including the image formation function and the image removal function with a simple structure at low cost and reduced environmental load along with the effects mentioned above.

According to the present invention, the reusable medium has discrimination information for recognizing reusability of the reusable medium, the first conveying path for supplying the recording material to the image formation unit and the second conveying path for supplying the recording material to the image removal device partially share a common path for conveying the recording material, and the recognition unit judging the discrimination information of the reusable medium is disposed on the common path for conveying the recording material. Thus, it is not necessary to dispose a recognition unit dedicated only to the image removal device. Further, the path for conveying the recording material is shared with the image formation apparatus and the image removal device, so that it is possible to provide an image formation and removal system with a simple structure at low cost and reduced environmental load.

According to the present invention, in the image formation apparatus, an image is formed in the image formation unit when a recording material appropriate for an image formation mode is detected before recording materials inappropriate for the image formation mode selected using the selection unit are successively detected for a predetermined number of times, and an image formation operation by the image formation unit is stopped when inappropriate recording materials are successively detected for the predetermined number of times, and ejection is performed without performing the image formation operation when inappropriate recording materials are successively detected for less than the predetermined number of times. Thus, even when the user erroneously mixes general paper in the first paper feed cassette where only those reusable media must be stored or when the user erroneously mixes a reusable medium in the second paper feed cassette where only general paper must be stored by contrast, it is possible to form an image on an intended recording material and complete an image formation operation. When inappropriate recording materials are detected successively for a set number of times, an image formation operation is stopped, so that it is possible to avoid unnecessary conveying of a recording material when the user erroneously sets a large amount of recording materials in the paper feed cassette. Further, an image to be removed is securely formed on the reusable medium, so that it is possible to reduce an amount of paper consumption and environmental load and to securely form image information on general paper so as to distribute such information required to be formed on general paper to customers, outside companies, or outside divisions.

According to the present invention, the image formation apparatus includes a warning unit outputting warning information for notifying that an inappropriate recording material is set when inappropriate recording materials are successively detected by the recognition unit for a predetermined number of times. Thus, it is possible to notify the user that the inappropriate recording material is set and prompt the user to set an appropriate recording material.

According to the present invention, the discrimination information in the reusable medium includes discrimination information recorded in an IC chip disposed on the reusable medium in an integrated manner. Thus, it is possible to store various types of information concerning the reusable medium and provide various types of detection forms, thereby readily managing reusable media.

According to the present invention, even when an image removal process operation is being performed successively by the image removal device, if an image formation instruction is input, the image removal process operation is suspended and an image formation operation is preferentially performed, and then after the image formation operation is ended, the image removal process operation is resumed. Thus, the image formation operation and the image removal operation are not performed at the same time. Further, excessive power consumption is avoided and complexity and difficulty of control are eliminated. Moreover, the image formation operation requiring high speed is promptly performed, so that reduction of operational efficiency by the user is minimized even when the image removal operation is performed.

According to the present invention, even when an image removal process operation is being performed on a recording material by the image removal device, the recording material being conveyed from a paper feed cassette disposed on the image formation apparatus or the image removal device, if an image removal process instruction is input for a recording material supplied from the manual paper feed unit, the image removal process operation on the recording material conveyed from the paper feed cassette is suspended and an image removal process operation on the recording material conveyed from the manual paper feed unit is preferentially performed, and then after the image removal process operation is ended, the image removal process operation on the recording material conveyed from the paper feed cassette is successively resumed. In accordance with this, the user sets the recording material on which highly-confidential information is recorded in the manual paper feed unit and the image removal process is immediately started. As a result, the image is removed in the presence of the user and it is possible to confirm whether reading of such information becomes impossible. Thus, it is possible to use the image removal device connected to the image formation apparatus as having the same function as a shredder and reuse the reusable medium from which the image is removed.

According to the present invention, an interrupt control is performed such that even when an image formation operation is being performed successively or an image removal process operation is being performed successively on a recording material by the image removal device, the recording material being conveyed from a paper feed cassette disposed on the image formation apparatus or the image removal device, if an image removal process instruction is input for a recording material supplied from the manual paper feed unit, the image formation operation or the image removal process operation on the recording material conveyed from the paper feed cassette is temporarily suspended and an image removal process operation on the recording material conveyed from the manual paper feed unit is preferentially performed, and then after the image removal process operation is ended, the suspended image formation operation or the image removal process operation on the recording material conveyed from the paper feed cassette is resumed. In accordance with this, the user sets the recording material in which highly-confidential information is recorded in the manual paper feed unit and the image removal process is immediately started. As a result, the image is removed in the presence of the user and it is possible to confirm whether reading of such information becomes impossible. Thus, it is possible to use the image removal device connected to the image formation apparatus as having the same function as a shredder and reuse the reusable medium from which the image is removed.

Other objects, features and advantage of the present invention will become more apparent from the following detailed description when read in conjunction with the accompanying drawings.

BEST MODE FOR CARRYING OUT THE INVENTION

Figure 1:
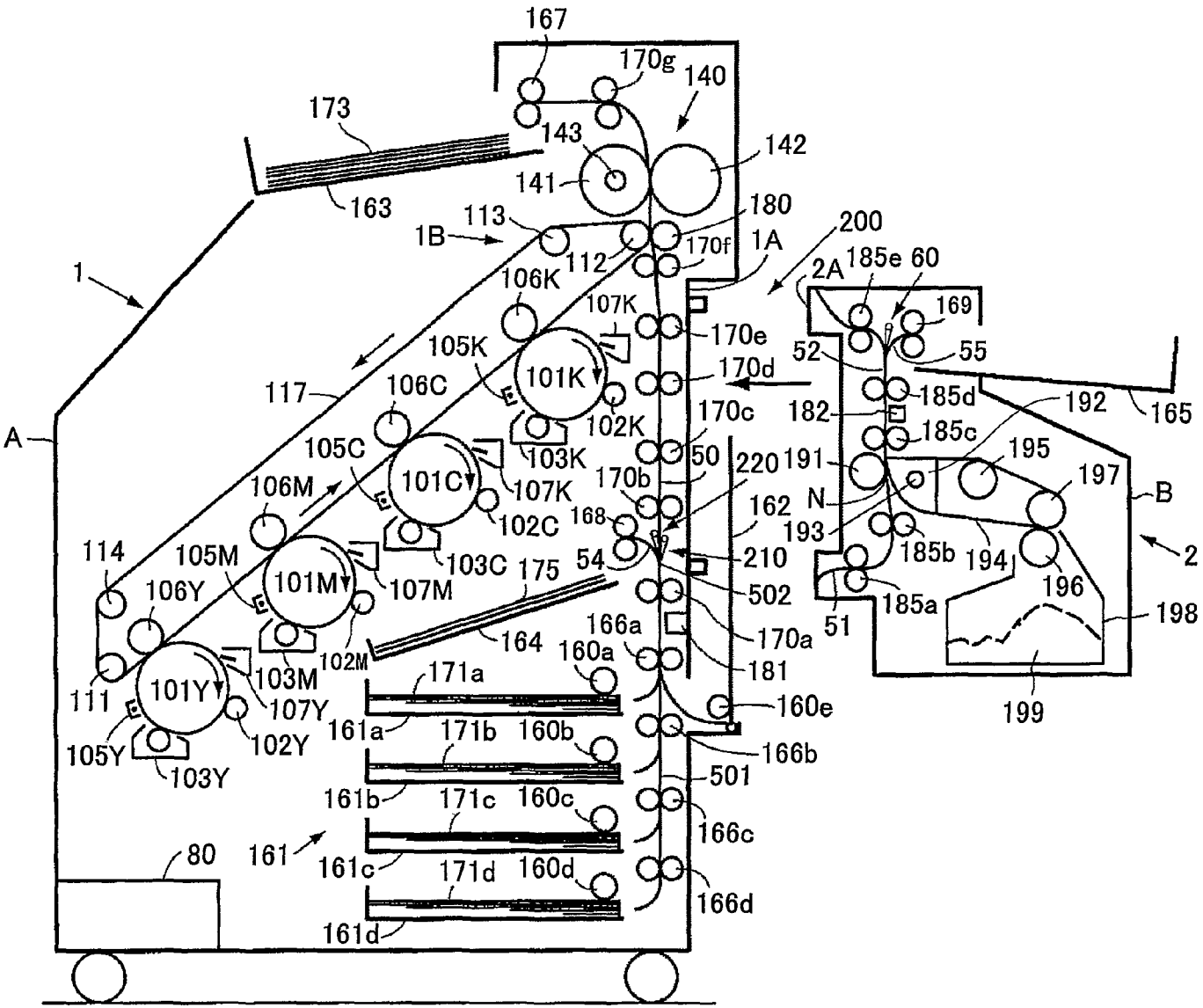
FIG. 1 is a schematic diagram showing an image removal device when it is detached and an image formation apparatus according to an embodiment of the present invention.

The present invention is described in detail based on the embodiments illustrated in the drawings. An image formation apparatus referenced at 1 in FIG. 1 shows an example of a color image formation apparatus for forming an image by electrophotography and a method for forming an image and elements of the apparatus are well-known as a tandem type color electrophotographic device. This image formation apparatus is assumed to have functions of a digital multifunction device. In order to add a copying function, a scanner unit used as an image reading device not shown in the drawings is added other than a structure shown in FIG. 1. When the image formation apparatus is used as a facsimile machine, a communication interface and a memory unit storing information (not shown in the drawings) are added. When the image formation apparatus is used as a printer, a data input unit and a memory unit storing information are added in the same manner.

In FIG. 1, a portion surrounded by a housing A used as an apparatus body shows an image formation apparatus 1 including an image formation unit 1B and a portion surrounded by a housing B shows an image removal device 2 installed on and detached from the housing A of the image formation apparatus 1.

The image formation unit 1B is configured to form an image by electrophotography in which toner images of yellow (Y), magenta (M), cyan (C), and black (K) are formed on photoconductors as separate image carriers, respectively, the toner images formed on each photoconductor are transferred to an intermediate transfer body and the images transferred to the intermediate transfer body are transferred to a recording material conveyed from a paper feed unit, and the toner images formed on the recorded medium are heated and pressurized for fixation by a fixation unit 140.

A drum unit used as stations for forming images of each of yellow (Y), magenta (M), cyan (C), and black (K) is constructed using elements of a conventionally used electrophotographic device. In other words, the drum unit includes: drum-like or belt-like photoconductors 101Y, 101M, 101C, and 101K in which metal and the like having a photoconductor layer is used as a substrate; charging units 102Y, 102M, 102C, and 102K including a charging roller, a wire charger, and the like, the charging units 102Y, 102M, 102C, and 102K uniformly charging the photoconductors 110Y, 101M, 101C, and 101K; a light irradiation unit (not shown in the drawings) exposing each of uniformly charged photoconductors in accordance with an image to be formed such as laser, LED, light emitter-liquid crystal light valve; developers 103Y, 103M, 103C, and 103K internally having a magnetic roller and a toner conveying roller, the developers 103Y, 103M, 103C, and 103K creating visual images of electrostatic latent images using powder toner formed on each photoconductor through the light irradiation; corona wire chargers 105Y, 105M, 105C, and 105K controlling charge of toner powder images formed on each photoconductor; electric field applying units 106Y, 106M, 106C, and 106K including a roller or a corona wire for transferring toner powder images formed on each photoconductor to an intermediate transfer belt 117 as an intermediate transfer body; cleaning units 107Y, 107M, 107C, and 107K removing powder toner remaining on each photoconductor after transfer, and the like.

In addition to these constituent elements, it is possible to add a suitable and conventionally used element as appropriate. For example, in order to remove electric charge on each photoconductor after images are transferred, it is possible to dispose an electricity removal unit such as an alternating-current charger, a light irradiator, and the like. Also, it is possible to construct a control system in which a voltage detection unit detecting voltage charged on each photoconductor and a voltage control unit controlling voltage applied to the charger are disposed such that surface potential charged on each photoconductor is maintained at a constant level even in a case of deterioration resulting from an environmental change or repetition of use. When removal of toner on each photoconductor is unnecessary after images are transferred, it is possible to eliminate the cleaning units 107Y, 107M, 107C, and 107K. Further, when charging the toner powder images formed on each photoconductor is unnecessary, it is possible to eliminate the corona wire chargers 105Y, 105M, 105C, and 105K.

The intermediate transfer belt 117 is an endless belt mainly made of resin having a volume resistivity of about $10^8$ to $10^{12}$ Ωcm. The intermediate transfer belt 117 is disposed so as to have inscribed circles of rollers 111, 112, 113, and 114 and is provided with suitable tension from a tension application mechanism not shown in the drawings. In order to remove toner remaining on the intermediate transfer belt 117, a belt cleaning unit such as a brush, roller, or the like removing powder toner on a belt surface may be disposed on the periphery of the intermediate transfer belt 117. Further, depending on necessity, an electricity removal unit or a charge unit may be disposed so as to remove or uniform electric charge remaining on the intermediate transfer belt 117 after powder toner is transferred to a recording material.

Figure 2:
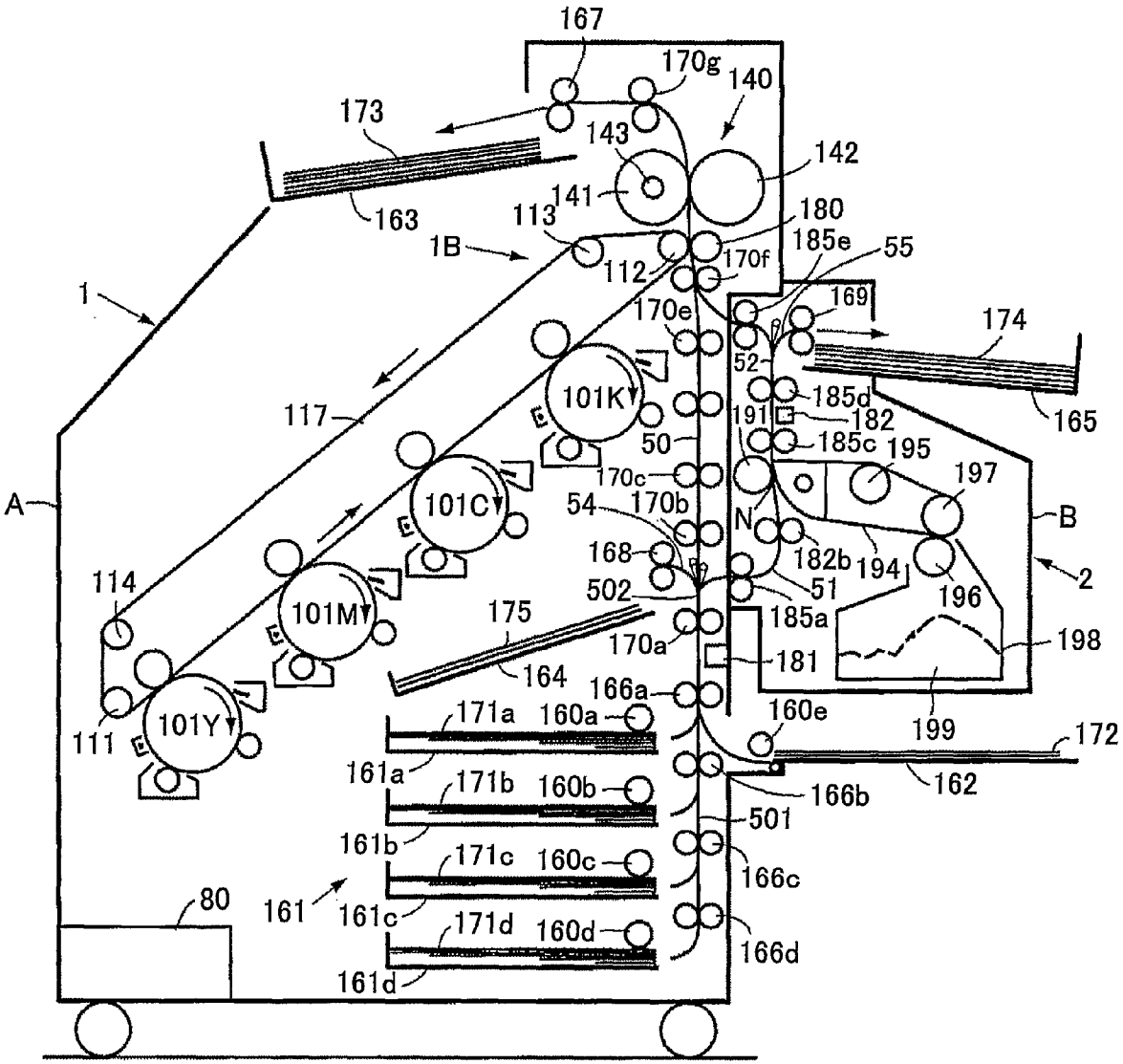
FIG. 2 is a schematic diagram showing an image formation apparatus including an image removal device installed thereon.

A recording material 171 (*a* to *d*) or a recording material 172 where a final image is formed is stored in plural paper feed cassettes 161*a*, 161*b*, 161*c*, and 161*d* disposed on a paper feed unit 161 positioned below the image formation unit 1B or stored in a manual paper feed tray 162 constituting a manual paper feed unit disposed on a lateral face of the housing A as shown in FIG. 2. In accordance with conditions and the like selected by the user, one of the paper feed cassettes or the manual paper feed tray 162 is selected and the recording material 171 (*a* to *d*) or the recording material 172 is sent to a first conveying path 50 via paper feed runners 160*a*, 160*b*, 160*c*, and 160*d* disposed in the vicinity of each paper feed cassette or a paper feed runner 160*e* disposed in the vicinity of the manual paper feed tray 162, the first conveying path 50 supplying the recording material to the image formation unit 1B. The recording material 171 (*a* to *d*) or the recording material 172 that has been fed is conveyed to the image formation unit 1B via pairs of paper feed rollers 166*a*, 166*b*, 166*c*, 166*d*, 170*a*, 170*b*, 170*c*, 170*d*, 170*e*, and 170*f* disposed on the first conveying path 50.

The toner powder images formed on the intermediate transfer belt 117 are transferred to the recording material 171 (*a* to *d*) or the recording material 172 in an image transfer unit where an electric field application unit 180 such as a voltage application roller, a corona wire charger, and the like is disposed.

The toner powder images transferred on the recording material 171 (*a* to *d*) or the recording material 172 are softened and fixed by the fixation unit 140 including a heating member 141 such as a thermal belt or a heating roller internally having a heating unit 143 such as a halogen lamp and a pressure roller 142 having a silicone rubber layer on a surface thereof. A recording material 173 on which the toner images are fixed are ejected to a paper ejection tray 163 disposed on a top portion of the housing A via a pair of rollers 170*g* for conveying a recording material and a pair of paper ejection rollers 167.

Figure 3:
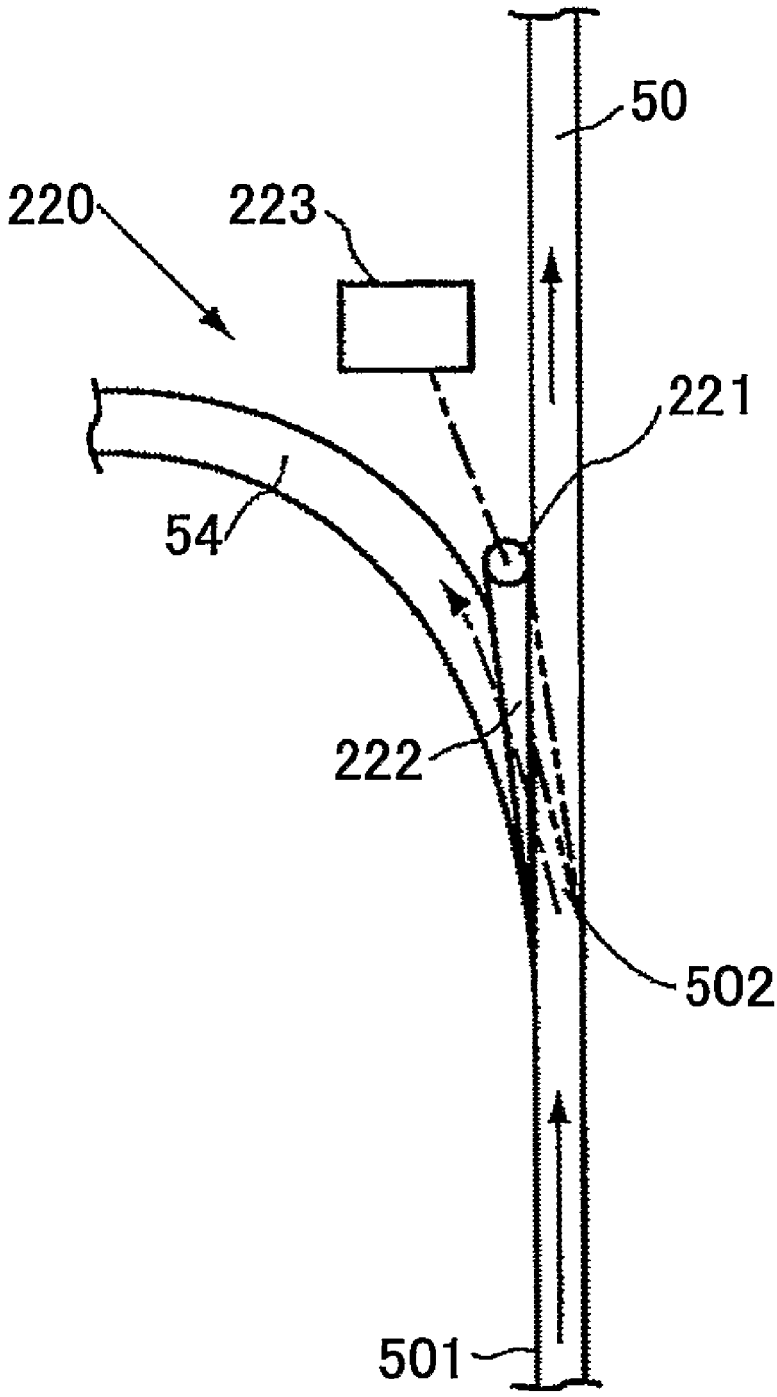
FIG. 3 is a schematic diagram showing an embodiment of a guide unit and operation thereof.

As shown in FIG. 1, above the paper feed cassette 161*a*, there are disposed a collection tray 164 for collecting non-image recording material 171 (*a* to *d*), a collection conveying path 54 for connecting the first conveying path 50 to the collection tray 164, a pair of collection rollers 168 disposed on the collection conveying path 54, and a guide unit 220 guiding the recording material in the first conveying path 50 to the collection conveying path 54. The guide unit 220 is disposed on a branching portion 502 between the first conveying path 50 and the collection conveying path 54 as shown in FIG. 3.

Figure 7:
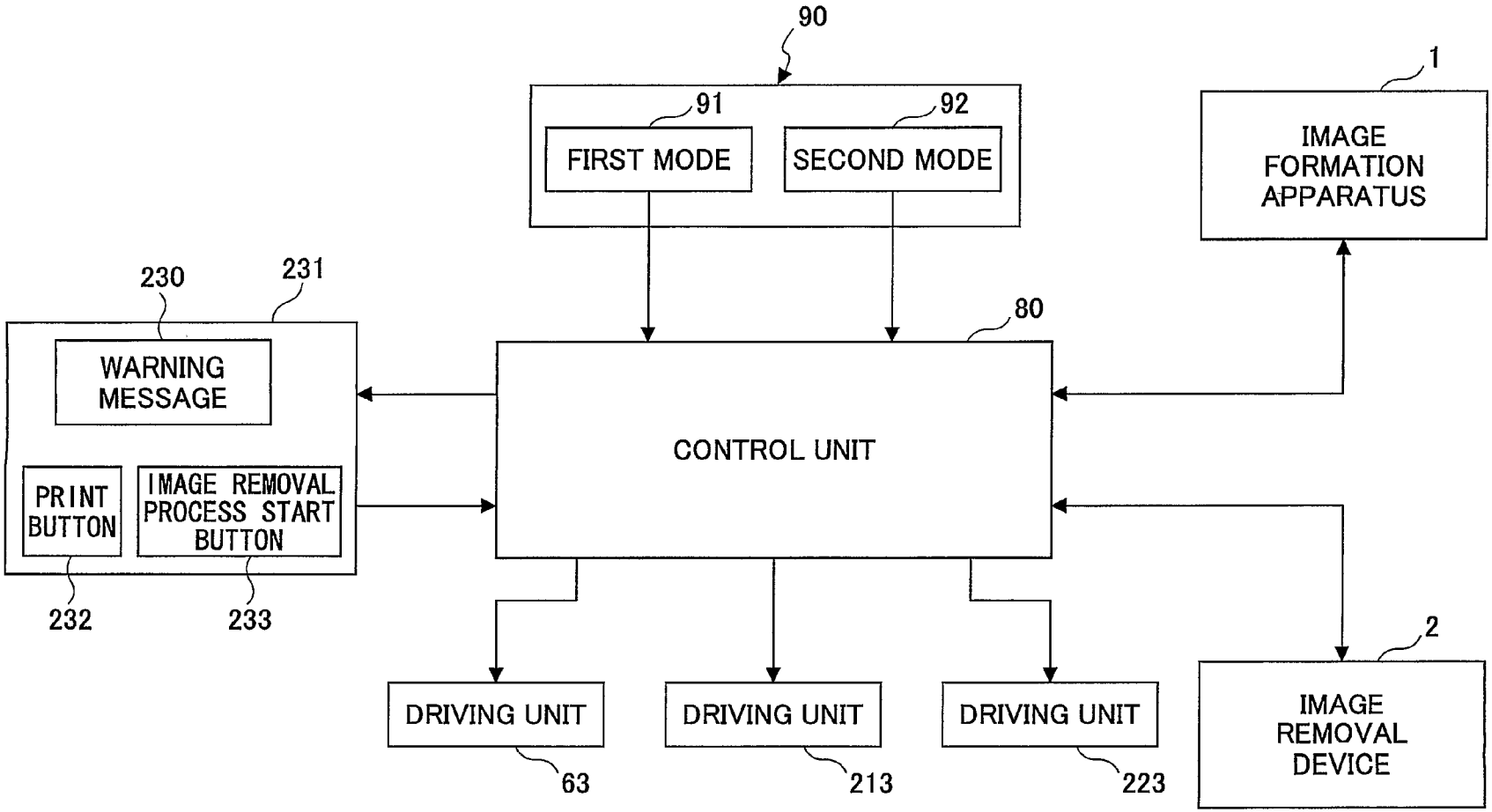
FIG. 7 is a block diagram showing a control unit and constituent elements connected thereto.

The guide unit 220 includes a guide flap 222 disposed on a rotation shaft 221 and a driving unit 223 switching a position of the guide flap 222 by rotating the rotation shaft 221. The guide flap 222 is configured to be positioned at a conveying position for conveying the recording material from the first conveying path 50 to the image formation unit 1B, the conveying position being indicated by a solid line, and at a collection position for guiding the recording material to the collection conveying path 54, the collection position being indicated by a two-dot chain line shown in FIG. 3. These positions are switched as appropriate by driving the driving unit 223. As shown in FIG. 7, the driving unit 223 is connected to a control unit 80 included in the image formation apparatus 1 and is driven based on a driving signal from the control unit 80. The control unit 80 is constructed using a conventionally used computer including a ROM, RAM, CPU, timer, and the like. The control unit 80 controls driving of the driving unit 223 such that the guide flap 222 is positioned at the collection position when the recording material is not a reusable media and positioned at the conveying position when the recording material is a reusable medium.

Image formation is possible using special toner whose color is eliminated from light and heat and toner containing wax components, fluorine resin, silicone resin, surface-active agent, and the like. However, preferably, toner generally employed for electrophotography is used so as to form an image in the same image formation apparatus when an image having preferable fixation is required for distribution outside the information control areas such as other divisions or companies, drawing up a contract, and the like. In other words, in the image formation apparatus 1 and the image removal device 2, conventionally used toner for electrophotography may be used as an example of image forming substances. More specifically, image forming substances containing the following components may be used.

Examples of conventionally used coloring material used for image forming substances include:

black pigment such as carbon black, iron oxide, and the like;

yellow pigment such as C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment Yellow 180, C.I. Pigment Yellow 185, and the like;

magenta pigment such as C.I. Pigment Red 2, C.I. Pigment Red 3, C.I. Pigment Red 5, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 166, C.I. Pigment Red 177, C.I. Pigment Red 178, C.I. Pigment Red 222, and the like; and cyan pigment such as C.I. Pigment Blue 15, C.I. Pigment Blue 15:2, C.I. Pigment Blue 15:3, C.I. Pigment Blue 16, C.I. Pigment Blue 60, and the like. When powder toner is used as image forming substances, these coloring materials are used from 0.5% to 20% by weight, preferably, from 1% to 10% by weight.

When a thermal transfer method is used for the image removal device 2, preferably, image forming substances having thermoplasticity is used. Examples of resin components providing image forming substances with thermoplasticity include conventionally used toner materials for electrophotography.

In other words, examples of resin components include polyester resin, styrenes such as polystyrene, poly-chlorostyrene, polyvinyl toluene, and polymers of substitution products thereof; styrene copolymers such as styrene-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethaacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer; polymethylmethacrylate, polybutylmethacrylate, polyvinyl chloride, polyvinyl acetate, polyethylene, polypropylene, polyester, epoxy resin, epoxy polyol resin, polyurethane, polyamide, polyvinyl butyral, polyacrylic resin, rosin, modified rosin, terpene resin, aliphatic or alicyclic hydrocarbon resin, aromatic petroleum resin, and the like. When powder toner is used as image forming substances, these resin components are used from 60 to 99.5% by weight of an entire toner, preferably, from 80 to 97% by weight.

When the toner powder images are fixed on the recording material by a heat fixing unit and the images are removed through a thermal transfer method in which the toner on the recording material is transferred to an image peeling member, it is important that a glass transition point (Tg), fusing temperature, and viscoelastic property of components of thermoplastic resin are within a suitable range. When the glass transition point ranges from 40 to 100° C., or preferably from 50 to 70° C., it is possible to fix at a relatively low temperature, remove the image forming substances from the recording material, and obtain preferable preservation stability for the toner.

When measurement frequency is 20 Hz, storage elastic modulus of the components of thermoplastic resin is 10000 dyne/cm$^2$ preferably at not less than 80° C., more preferably from 90 to 160° C.

Conventional materials are used for toner as appropriate including charge control agent, release agent, external additive, and the like. Examples of the charge control agent include nigrosine dye, triphenylmethane dye, molybdic acid chelate pigment, rhodamine dye, alkoxylamine, quarternary ammonium salt, fluorine-containing activating agent, metal salt of salicylic acid, and metal salt of salicylic acid derivative, and the like.

Components of the release agent are added to as to prevent adhesion of toner to a fixing roller or a fixing belt (prevention of hot offset) upon fixing when the heat fixing unit is used. Examples of waxes to be used as release agent having a melting point of 60 to 110° C. include carnauba wax, montan wax, bees wax, paraffin wax, microcrystalline wax, and the like.

The external additive is added so as to assist flowability, development, charge of powder toner and is usually added so as to cover a surface of particles made of coloring material and resin. Examples of inorganic particles to be used as external additive include silica, alumina, titanium oxide, barium titanate, magnesium titanate, calcium titanate, strontium titanate, zinc oxide, tin oxide, silica sand, clay, mica, wollastonite, diatom earth, chromium oxide, ceric oxide, ferric oxide, antimony trioxide, magnesium oxide, zirconium oxide, barium sulfate, barium carbonate, calcium carbonate, silicon carbide, silicon nitride, and the like. Preferably, a primary particle size of these inorganic particles ranges from 2 nm to 5 nm, more preferably from 5 nm to 500 nm. Preferably, an amount of inorganic particles used in toner ranges from 0.01 to 5% by weight of an entire amount of image forming substances, more preferably from 0.01 to 2.0% by weight.

Conventional manufacturing methods including mixing and milling, dispersion polymerization, suspension polymerization, and the like may be uses as a method for manufacturing powder of image forming substance from the above-mentioned materials.

The image formation apparatus 1 according to the present embodiment is constructed such that the image removal device 2 is detachably installed as an optional unit on the housing A. However, the image formation apparatus 1 and the image removal device 2 may be integrally combined and connected in, advance so as to be constructed as an image formation apparatus.

The image removal device 2 added and connected to the housing A as an optional unit employs a thermal transfer method as an image removal method in which toner on a recording material is transferred to an image peeling member. In FIGS. 1 and 2, the recording material from which an image is to be removed after use of image information formed as an image is stored in the fourth paper feed cassette 161*d* in the paper feed unit 161 or set in the manual paper feed tray 162, for example, and is supplied to the image formation unit 1B.

In the housing A, there are disposed a installation unit 200 detachably enabling installation of the image removal device 2 on the housing A and a switch unit 210 switching supply of the recording material 171 or the recording material 172 to the image removal device 2 or the image formation apparatus 1.

Figure 5:
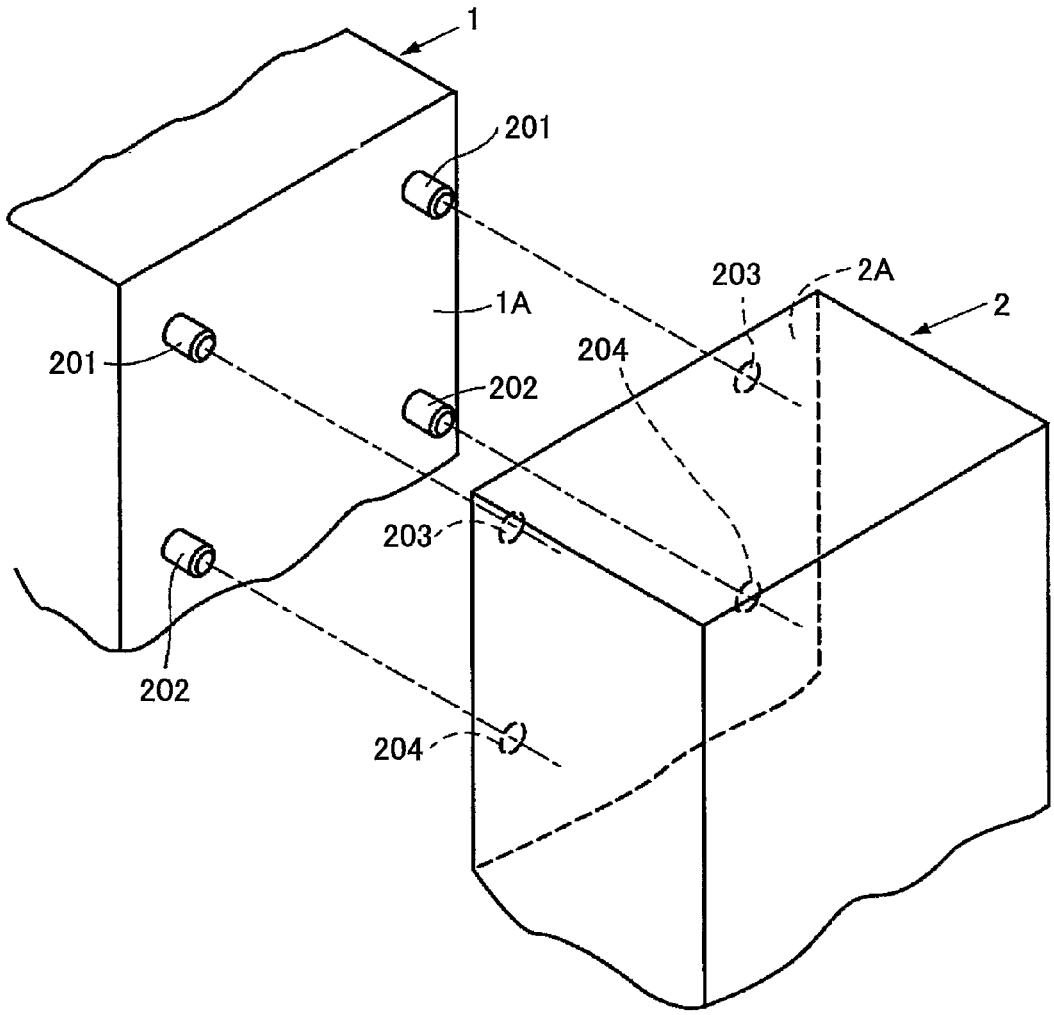
FIG. 5 is a perspective view showing an embodiment of an installation unit.

As shown in FIG. 5, the installation unit 200 includes plural pins 201 and 202 formed on a side plate 1A of the housing A positioned on a first conveying path 50 side, perforations 203 and 204 formed on a side plate 2A positioned on a side of the following second and third conveying paths 51 and 52 of the image removal device 2, the perforations 203 and 204 capable of being detachably engaged with each pin, and screws not shown in the drawings. In the present embodiment, the image removal device 2 is positioned when the pins 201 and 202 are inserted into the perforations 203 and 204, respectively, and is mechanically installed on the image formation apparatus 1 as shown in FIGS. 1 to 2 using the screws not shown in the drawings. In this case, using a connector not shown in the drawings, the control unit 80 disposed on the image formation apparatus 1 and a power supply not shown in the drawings are connected to the image removal device 2.

In the installation unit 200, instead of the pins 201 and 202 disposed on the side plate 1A of the image formation apparatus 1, plural opening portions extending in the vertical or lateral direction may be formed and a hook portion capable of being detachably engaged with each opening portion may be formed on the image removal device 2 side. The image removal device 2 may be installed on the housing A by inserting each hook portion into the opening portion and sliding the hook portion downward or sliding the hook portion in the lateral direction.

Figure 4:
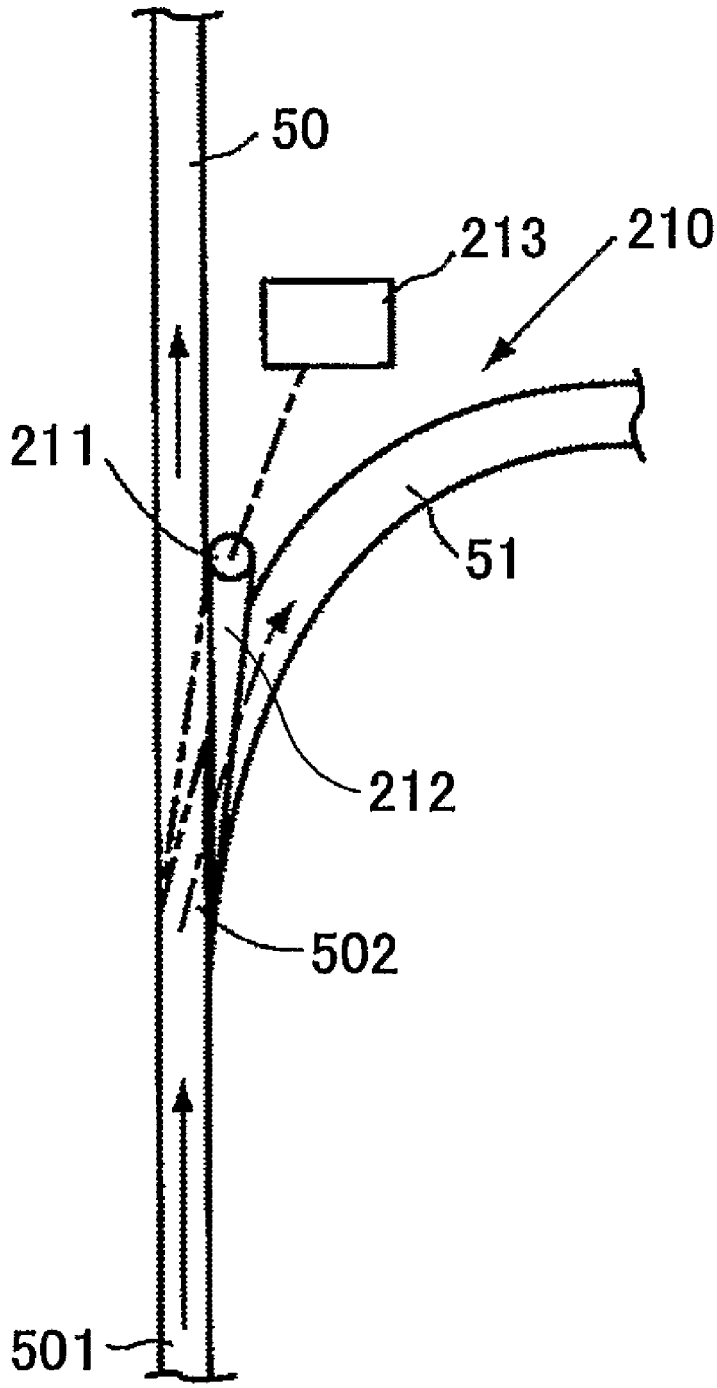
FIG. 4 is a schematic diagram showing an embodiment of a switch unit and operation thereof.

As shown in FIG. 4, the switch unit 210 is disposed on the branching portion 502 between the first conveying path 50 and the second conveying path 51. The switch unit 210 includes a flap 212 disposed on a rotation shaft 211 and a driving unit 213 switching a position of the flap 212 by rotating the rotation shaft 211. The guide flap 212 is configured to be positioned at a first position for conveying the recording material from the first conveying path 50 to the image formation unit 1B, the first position being indicated by a solid line, and at a second position for guiding the recording material to the second conveying path 51, the collection position being indicated by a two-dot chain line shown in FIG. 4. These positions are switched as appropriate by driving the driving unit 213. As shown in FIG. 7, the driving unit 213 is connected to the control unit 80 and is driven based on a driving signal from the control unit 80. The control unit 80 controls driving of the driving unit 213 such that the flap 212 is positioned at the second position when an image on the recording material is removed and positioned at the first position upon image formation.

In other words, in the first conveying path 50, a recording material conveying path 501 common to the second conveying path 51 is constructed from the paper feed unit 161 and the manual paper feed tray 162 to the branching portion 502 between the first conveying path 50 and the second conveying path 51. The recording material fed from the paper feed unit 161 and the manual paper feed tray 162 is conveyed through the recording material conveying path 501 to the branching portion 502 and destination is switched by the switch unit 210.

As shown in FIGS. 1 and 2, the image removal device 2 includes a block 192 constructed using aluminum internally having a halogen lamp 193 as a heat source, a pressure roller 191 having an elastic member such as silicon rubber, fluorine-containing rubber, polyurethane rubber, and the like on a surface thereof, the pressure roller 191 being made of stainless steel, aluminum, iron, and the like and forming a nip portion N when in contact with the block 192, an image peeling member 194 having an endless belt-like shape for transferring toner formed on a recording material, a rotating cleaning blade 196 having a spiral shape, a container 198 for storing separated toner, the second conveying path 51 for supplying the recording material to the nip portion N, the third conveying path 52 for returning the recording material passed through the nip portion N to the first conveying path 50, pairs of conveying rollers 185*a*, 185*b*, 185*c*, and 185*d* disposed on the second and third conveying paths 51 and 52 as conveying units, a pair of paper ejection rollers 169 and a paper ejection path 55 for ejecting the recording material (reusable medium) from the third conveying path 52 to a medium ejection tray 165, and a guide unit 60 guiding the recording material (reusable medium) to the first conveying path 50 or the paper ejection path 55.

The image peeling member 194 is made of metal such as nickel, stainless steel, and the like or polymer compound such as polyethylene terephthalate, polyimide, aramid, polyethylene naphthalate, polyetheretherketone, and the like. The image peeling member 194 is installed so as to have inscribed elements of the block 192, a cleaning backup roller 197, and a tension roller 195. The nip portion N is formed between the pressure roller 191 and the block 192 where pressure is added from a pressure unit such as a spring not shown in the drawings, water pressure, air pressure, and the like.

In the vicinity of the block 192, there is disposed a temperature detection unit not shown in the drawings, the temperature detection unit being selected from a thermistor, thermocouple, platinum resistance, infrared sensor, and the like. A signal from the temperature detection unit is input to the control unit 80. Lighting of the halogen lamp 193 in the block 192 is controlled by the control unit 80 using the input signal, so that surface temperature of the block 192 is controlled to be constant within a range from 80 to 150° C., for example.

The medium ejection tray 165 is disposed on a top portion of the housing B and is detachably installed on the image formation apparatus 1 in an integral manner with the image removal device 2. A reusable medium from which an image is basically removed is ejected to the medium ejection tray 165.

Figure 6:
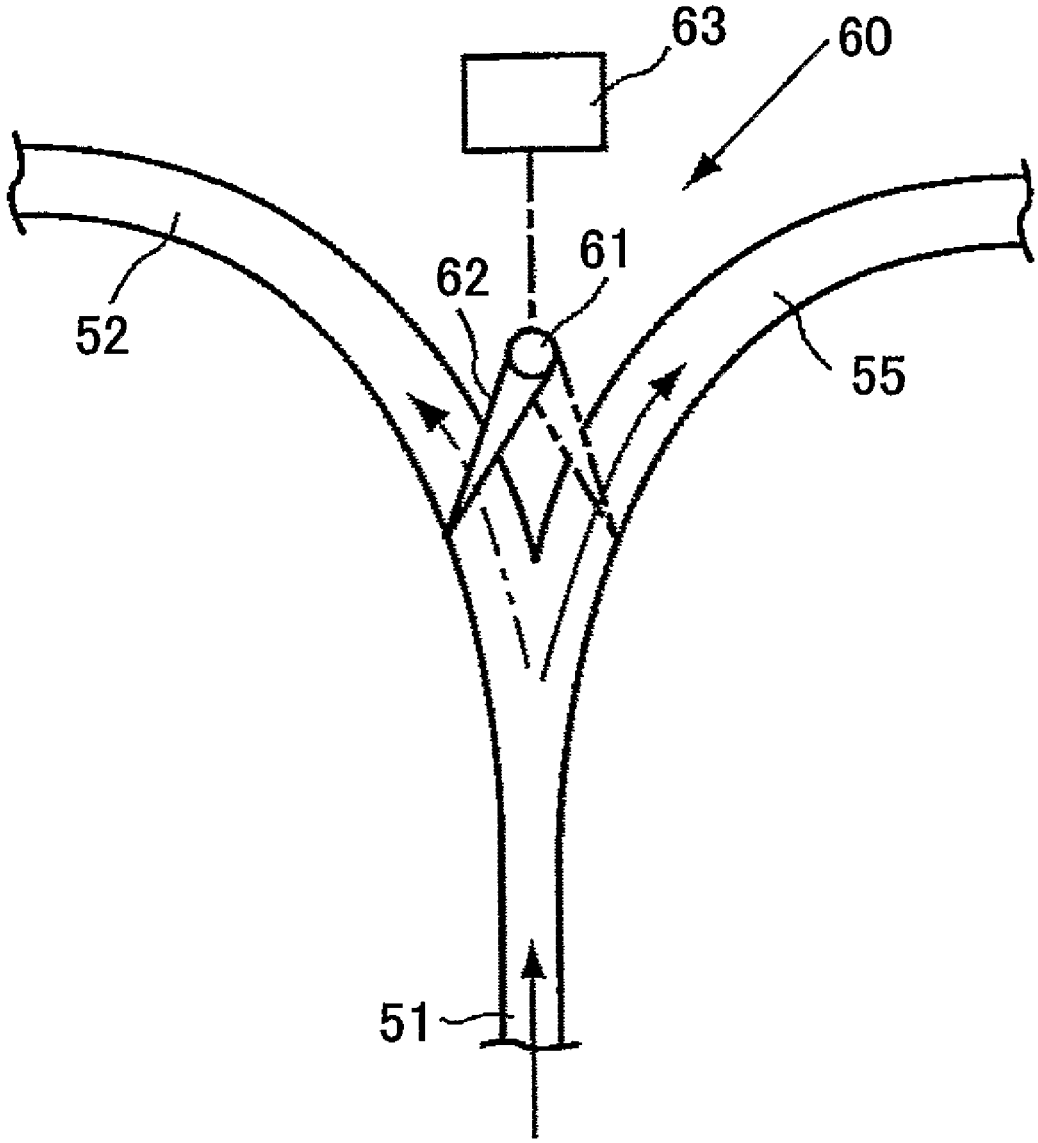
FIG. 6 is a schematic diagram showing a structure of a guide unit disposed on an image removal unit and operation thereof.

As shown in FIG. 6, the guide unit 60 is disposed on a branching portion between the third conveying path 52 and the paper ejection path 55. The guide unit 60 includes a flap 62 disposed on a rotation shaft 61 and a driving unit 63 switching a position of the flap 62 by rotating the rotation shaft 61. The flap 62 is configured to be positioned at a reuse position for guiding a recording material 174 (reusable medium) from which an image is removed to the paper ejection path 55, the reuse position being indicated by a solid line, and at a paper ejection position for guiding the reusable medium in an inappropriate status to the first conveying path 50, the paper ejection position being indicated by a two-dot chain line shown in FIG. 6. These positions are switched as appropriate by driving the driving unit 63. As shown in FIG. 7, the driving unit 63 is connected to the control unit 80 and is driven through the driving signal from the control unit 80. The control unit 80 controls driving of the driving unit 63 such that the flap 62 is positioned at the reuse position in a case of the reusable medium from which an image is removed and positioned at the paper ejection position in a case of the reusable medium in the inappropriate status. The reusable medium in the inappropriate status refers to a reusable medium from which an image is not completely removed.

The recording material 171*d* or the recording material 172 to be used as a reusable medium from which an image is removed is conveyed in the recording material conveying path 501 by the pairs of paper feed rollers 166*d*, 166*c*, 166*b*, 166*a*, and 170*a*, guided to the second conveying path 51 by the switch unit 210, and guided to the nip portion N formed using the pressure roller 191 and the block 192 by the pair of conveying rollers 185*a* and 185*b*. The recording material 171*d* or the recording material 172 is heated and pressurized while passing through the nip portion N and toner on the recording material is pressurized in a softened status, so that the toner is adhered to the image peeling member 194.

An edge portion disposed downstream relative to the block 192 has a curvature of about 1 to 5 mm radius. Since the image peeling member 194 is conveyed in accordance with the curvature, the recording material and the image peeling member 194 are separated due to rigidity of the recording material. In this case, by using a reusable medium as a recording material in which adhesion to toner is adjusted to be reduced in comparison with adhesion to the image peeling member 194, the toner on the recording material is transferred to the image peeling member and an image formed on the recording material is removed.

The toner transferred to the image peeling member 194 from the recording material is scraped off by the rotating spiral-shaped cleaning blade 196 and is collected in the container 198 disposed below the cleaning blade 196. The recording material 174 from which an image is removed is guided to the paper ejection path 55 by the guide unit 60 shown in FIG. 6 after passing through the pairs of conveying rollers 185*c* and 185*d*, and then stocked in the medium ejection tray 165 by the pair of paper ejection rollers 169.

Figure 8A:
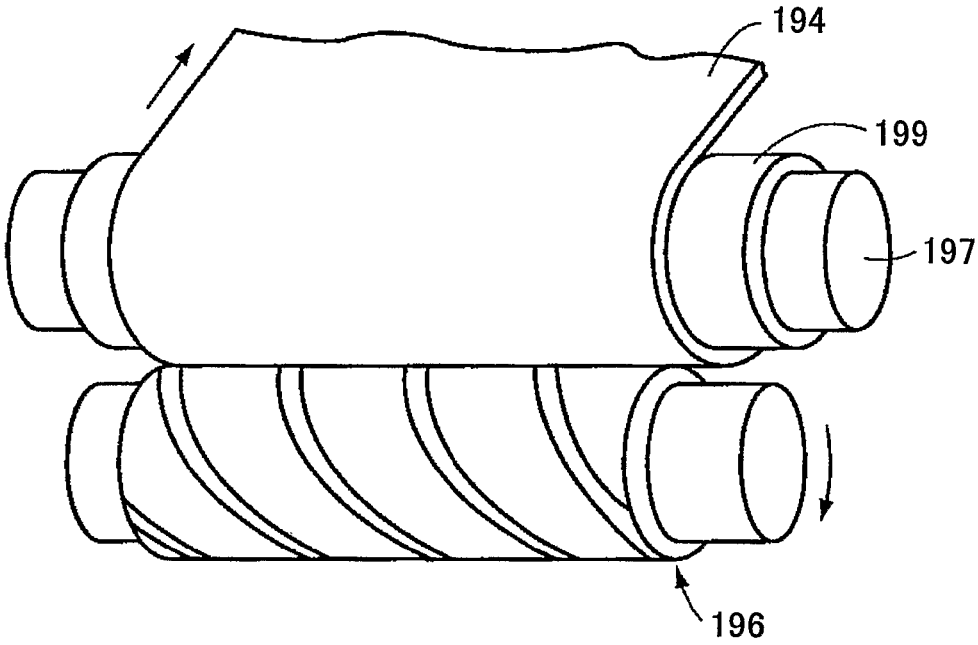
FIG. 8A is an enlarged perspective view showing a structure of a cleaning unit of an image removal unit.
Figure 8B:
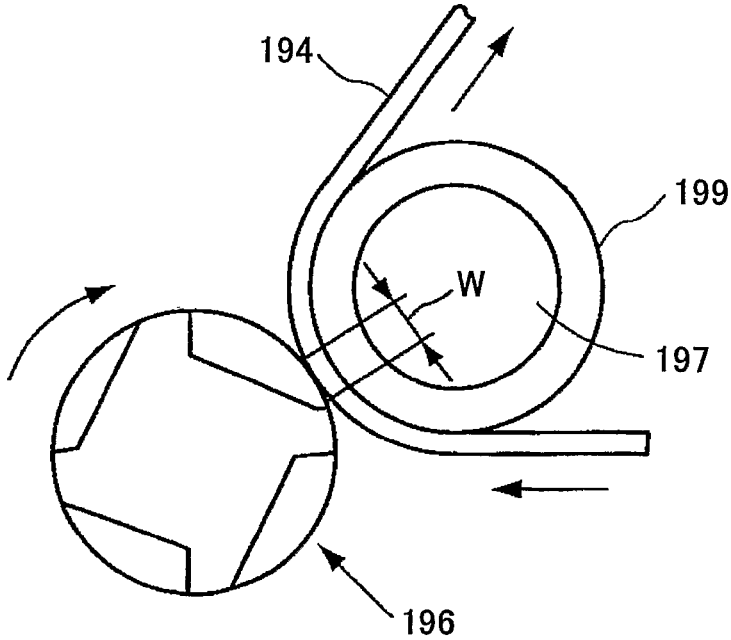
FIG. 8B is an enlarged front view showing the cleaning unit.

FIG. 8A and FIG. 8B are a perspective view and a front view showing a schematic structure of a cleaning unit removing toner from the image peeling member 194. The cleaning unit is constructed using the roller-shaped cleaning blade 196 having a spiral-shaped edge on a circumferential portion and being driven for rotation and the cleaning backup roller 197. Predetermined pressure loading is applied between the cleaning blade 196 and the cleaning backup roller 197 by a biasing unit selected from a spring, water pressure unit, air pressure unit, and the like not shown in the drawings. An elastic body is formed on a surface portion 199 of the cleaning backup roller 197 using rubber of relatively low hardness having a JIS-A hardness of about 20, sponge, and the like. The cleaning backup roller 197 and the cleaning blade 196 form a nip (width W). The cleaning blade 196 is rotated in an opposite direction relative to a conveying direction of the image peeling member 194.

The reusable medium used in the present invention is a recording material including compounds for reducing fixing power to the image forming substances at least in the vicinity of a surface thereof or compositions for removing a portion of a surface layer along with the image forming substances when physical energy such as light, heat, and the like is applied or water washing is performed by a washing unit, for example. A substrate thereof may be any of paper having cellulose fiber as a main body, synthetic paper made of plastic film having a foam structure and the like, polyethylene terephthalate (PET), polypropylene (PP), and film made of thermoplastic resin such as acetate film. However, paper is most preferably used as a substrate in view of the facts that a manufacturing cost is moderate, electric charge does not remain for a long time when the recording material is charged in the image formation apparatus, electric shock is not provided to the user, and the paper is capable of being dissolved into cellulose fiber and recycled when a repetition of reuse becomes difficult.

When paper is used as a substrate, the substrate may be made from any of wood such as chemical pulp and mechanical pulp, nonwood cellulose fiber such as bagasse and kenaf, recycled pulp of waste paper gained from used paper after deinking, pulp gained from dissolved waste sheet, and the like.

Examples of the compounds for reducing fixing power to the image forming substances include fluorine compound, silicon compound, surface-active agent containing a straight-chain or branched higher alkyl group or alkenyl group, wax, and polymer compound. More specifically, examples of the compounds for reducing fixing power to the image forming substances include saponified alkenyl succinic anhydride, fatty acid alkali salt such as sodium stearate, potassium lauryl, sodium behenate, and potassium oleate, alkyl phosphate alkali salt such as monostearyl sodium phosphate and distearyl sodium phosphate, dialkyl sulfosuccinate such as dodecylbenzene sulfonate, dodecyl sulfonate, dihexyl sulfosuccinate, and dioctyl sulfosuccinate, anionic surface-active agent such as alkyl ether acetate, alkylnaphthalenesulfonate, alkyl ether sulfate, alkyl sulfate of alkylamide sulfate, and alkyl ether phosphate, ether esters such as polyoxyethylene nonylphenyl ether, polyoxyethylene dodecylphenyl ether, polyoxyethylene oleyl phenyl ether, polyoxyethylene dodecyl ether, polyoxyethylene stearyl ether, polyoxyethylene oleyl ether, polyoxyethylene glycerine fatty acid ester, polyoxyethylene sorbitan fatty acid ester, and polyoxyethylene sorbitol fatty acid ester, esters such as polyethylene glycol fatty acid ester, fatty monoglyceride, polyglyceryl fatty acid ester, sorbitan fatty acid ester, propylene glycol fatty acid ester, and sucrose fatty acid ester, nonionic surface-active agent such as aliphatic alkanolamide, polyoxyethylene fatty acid amide, polyoxyethylene alkylamine, and alkylamine oxide, cationic surface-active agent such as alkylamine salt and alkyl quaternary ammonium salt, fatty acids such as stearic acid, lauric acid, palmitic acid, and behenic acid, fatty amides such as lauric acid amide, stearic acid amide, and oleic amide, N-substituted fatty acid amides such as N-oleyl stearic acid amide, N-oleyl oleic amide, N-stearyl oleic amide, N-stearyl stearic acid amide, N,N'-ethylene-bis oleic amide, N,N'-ethylene-bis lauric acid amide, N,N'-methylene-bis stearic acid amide, and N,N'-ethylene-bis behenic acid amide, alcohols such as lauryl alcohol, stearyl alcohol, cetyl alcohol, ceryl alcohol, myristyl, alcohol, melissyl alcohol, myricyl alcohol, cello-melissyl alcohol, oleyl alcohol, gadoleyl alcohol, and zoomaric alcohol, amines such as oleylamine, dodecyl amine, dioctadecylamine, and tetradecylamine, ketones such as laurone and stearone, phosphate compounds such as lauryl phosphate and stearyl phosphate, phosphate esters such as stearyl phosphate ester, lauryl phosphate ester, and behenyl phosphate ester, natural waxes such as candelilla wax, carnauba wax, rice bran wax, bees wax, lanolin, spermaceti wax, sumac wax, and montan wax, silicon resin, fluorine resin, and polymer containing a straight-chain or branched alkyl group with a carbon number of 6 or more or an alkenyl group with a carbon number of 6 or more as a side chain. Specific examples of such compounds include acrylic ester polymer and methacrylate ester polymer containing a straight-chain or branched alkyl group with a carbon number of 6 or more or an alkenyl group with a carbon number of 6 or more.

More specific examples include polymers and copolymers containing monomers of acrylic ester and methacrylate ester such as stearyl (straight-chain C18) acrylic ester, stearyl (straight-chain C18) methacrylate ester, cetyl (straight-chain C16) acrylic ester, cetyl (straight-chain C16) methacrylate ester, mistyryl (straight-chain C14) acrylic ester, mistylic (straight-chain C14) methacrylate ester, lauryl (straight-chain C12) acrylic ester, and lauryl (straight-chain C12) methacrylate ester.

A required level of reduction of fixing power to the image forming substances changes depending on materials constituting the image forming substances, especially, in accordance with factors such as resin component, surface smoothness of the substrate, adhesion of the image peeling member relative to the image forming substances in the image removal device, and the like. So as to adjust fixing power to toner, to fix the above-mentioned compounds in the vicinity of a surface of the recording material, and the like, it is possible to mix polymer which does not reduce the fixing power to the image forming substances, more specifically, compounds such as polyvinyl alcohol, starch, polyacrylic acid, polymethacrylic acid, polyacrylic ester, polymethacrylic acid ester, polyvinyl acetate, styrene-butadiene copolymer, and the like with the above-mentioned compounds reducing the fixing power to the image forming substances and to provide the mixture to the reusable medium. Further, it is possible to mix white pigment such as calciumcarbonate, kaoline, clay, talc, titaniumoxide, zinc oxide, and the like with the compounds reducing the fixing power to the image forming substances and to provide the mixture to the reusable medium.

The reusable medium used in the present invention is provided with information for indicating a reusable medium in order to discriminate the reusable medium from a general recording material incapable of removing an image. Preferably, the information for indicating as a reusable medium is not erased upon forming image information thereon or removing an image therefrom. Moreover, the information preferably allows the image formation apparatus 1 and the image removal device 2 to readily recognize the information as a reusable medium and the user to readily recognize the information by visual observation. It is possible to record such discrimination information on the reusable medium as a barcode, for example, using UV curable ink, dye ink, and the like through a printing method, ink-jet recording method, and the like. Further, it is also preferable to dispose a cutout or a hole on the reusable medium as a method for providing discrimination information. In order to enable the image formation apparatus 1 or the image removal device 2 to recognize the reusable medium, discrimination information may be printed using ink absorbing light having a wavelength unrecognizable for human eyes such as ultraviolet rays or infrared rays, ink emitting fluorescence, and magnetic ink, and an IC chip responding to electromagnetic waves may be disposed in which the discrimination information is stored.

Figure 9:
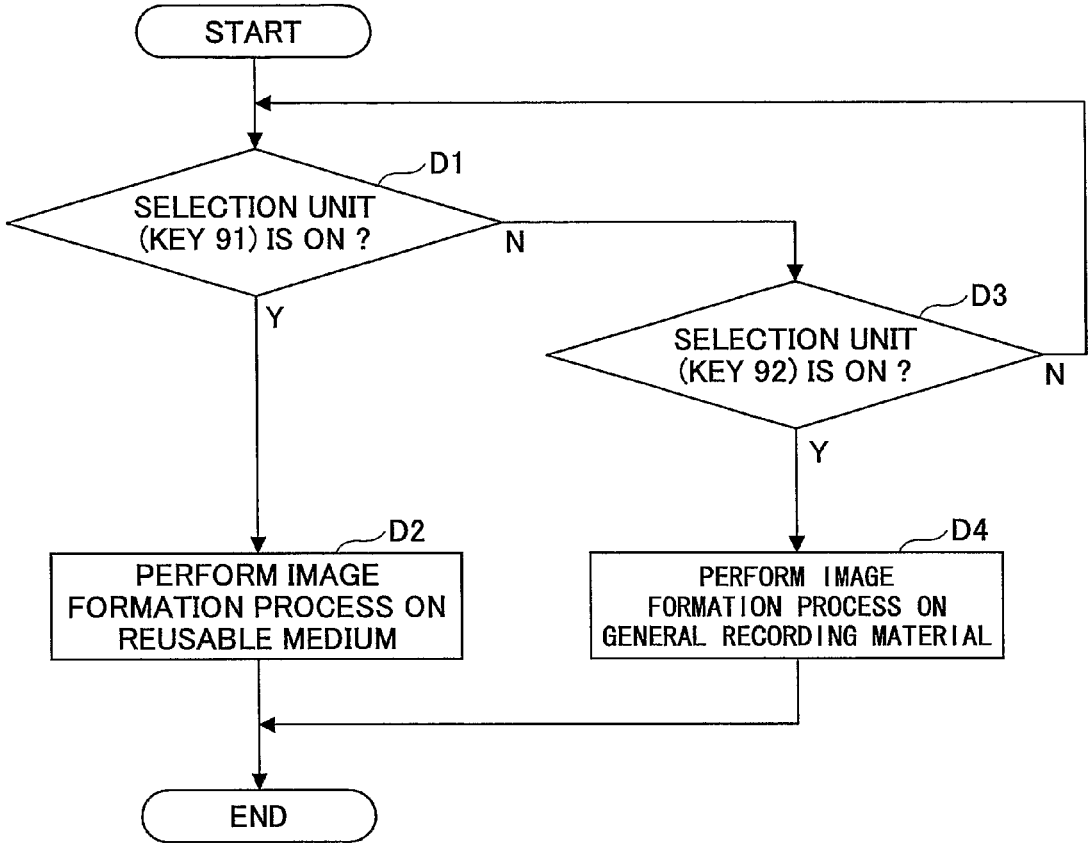
FIG. 9 is a flowchart showing an embodiment of control by a control unit.

As shown in FIG. 7, the image formation apparatus 1 includes a selection unit 90 for allowing the user to arbitrarily select modes using a key 91 for selecting a first image formation mode in which an image is formed on the reusable medium on the assumption that the image information formed for recording is used for a short period of time and the reusable medium is subjected to a process for removing the image forming substances after the use and a key 92 for selecting a second image formation mode in which an image is formed on paper as a general recording material. The selection unit 90 is connected to the control unit 80. As shown in FIG. 9, the control unit 80 is configured to control operation of the image formation apparatus 1 such that when the key 91 is operated (step D1) so as to select the first image formation mode, an image is formed on the reusable medium (step D2) and when the key 92 is operated (step D3) so as to select the second image formation mode, an image is formed on a general recording material (step D4).

In the present embodiment, although the keys 91 and 92 are employed as the selection unit 90, for example, selection may be performed using a selection unit such as a dial, stick, or the like. Moreover, when the image formation apparatus 1 is connected to an external information processing terminal via a network, namely, when the image formation apparatus 1 is connected to a computer capable of accessing the network, for example, the selection unit 90 may be a user interface on a display connected to the computer. The image formation apparatus 1 includes a warning unit 230 outputting warning information so as to notify that an appropriate recording material is not set. As shown in FIG. 7, the warning unit 230 is disposed on an operation panel 231 and is connected to the control unit 80.

In the present embodiment, at least one of the paper feed cassettes 161*a* to 161*d* constituting a portion of the paper feed unit 161 is configured to be set as a paper feed cassette for storing a reusable medium. Preferably, a paper type indication unit such as a dial, lever, or the like capable of changing a position thereof in accordance with paper type is disposed on the paper feed cassette so as to allow the user to recognize that the reusable medium is stored.

For example, in FIGS. 1 and 2, the paper feed cassette 161*d* is used as a first paper feed cassette for reusable media and the paper feed cassettes 161*a*, 161*b*, and 161*c* are used as second paper feed cassettes for general recording materials.

A sensor 181 used as a recognition unit is disposed on the recording material conveying path 501, the sensor 181 detecting the discrimination information provided to the reusable medium. A specific recognition unit depends on the discrimination information provided to the reusable medium. For example, when a cutout or a hole is disposed, a simple recognition unit detecting the cutout or the hole may be used merely combining a light-emitting element such as an LED and a light-receiving element such as a photoelectric cell. However, when reading an image pattern such as a bar code, two-dimensional bar code, and the like and a special pattern indicating a reusable medium, it is necessary to use a recognition unit capable of reading an image pattern such as a line sensor prepared by disposing a CCD element on a line.

In the first image formation mode for forming an image on the reusable medium, preferably, the image formation apparatus 1 provides discrimination information to a portion of the reusable medium so as to clearly indicate that the image is formed by an image formation apparatus capable of removing the image. The discrimination information is formed using the same image forming substances as the image forming substances for recording other information on the reusable medium so as to be removed by the image removal device 2. When the first image formation mode is selected, by providing the reusable medium with discrimination information indicating that the image is formed by a specific image formation apparatus, it is possible to discriminate a reusable medium on which an image is formed by an image formation apparatus incapable of removing the image between a reusable medium from which an image can be removed.

In other words, when simply detecting the presence or absence of the discrimination information provided to the reusable medium in advance, it is impossible to recognize a mixed reusable medium on which an image is formed by an image formation apparatus other than a specific image formation apparatus and the image forming substances are not removed therefrom because of mismatching of physical properties of the image forming substances and conditions of image formation. Accordingly, it is not possible to prevent trouble when the image is not completely removed in the image removal device 2, the image peeling member 194 and the reusable medium are not separated and jam is generated, or the image peeling member becomes unusable. However, by discriminating images and determining which image formation apparatuses have formed such images, it is possible to exclude those reusable media having images that have not been formed by the specific image formation apparatus 1 and prevent failure of elimination of images.

Preferably, the sensor 181 detects not only the discrimination information provided to the reusable medium in advance but also the presence or absence of the above-mentioned discrimination information provided when an image is formed in the first image formation mode of the image formation apparatus 1. The discrimination information provided when the image is formed in the first image formation mode of the image formation apparatus 1 may be a pattern unreadable for the user such as a bar code or a character pattern such as "reusable paper". Moreover, the discrimination information may be selected from several types of patterns prepared by the user in advance or the discrimination information may be a pattern arbitrarily created by the user and stored through reading.

In FIGS. 1 and 2, the sensor 181 functions as a unit detecting the discrimination information indicating the reusable medium formed on the reusable medium upon image formation. When the image removal device 2 is installed, upon image removal, the sensor 181 also functions as a unit detecting the presence or absence of the discrimination information provided when an image is formed on the reusable medium in the first image formation mode. As shown in FIGS. 1 and 2, by disposing the sensor 181 on the recording material conveying path 501, only a single set of sensors effectively functions upon image formation and image removal and provides great effects in that the apparatus is simplified, the number of components is reduced, and a cost and environmental load are reduced.

In the present embodiment, the reusable medium is stored only in the specific paper feed cassette 161*d* shown in FIGS. 1 and 2. When the user selects the first image formation mode, a recording material on which an image is to be formed is controlled to be supplied from the paper feed cassette 161*d*. Thus, there is little possibility that the image is formed on a recording material which is not a reusable medium in the first image formation mode. However, the user may erroneously mix a general recording material with reusable media in the paper feed cassette 161*d*. In view of this, the sensor 181 detects the presence or absence of the discrimination information on the recording material conveyed upon each image formation instruction.

Figure 10:
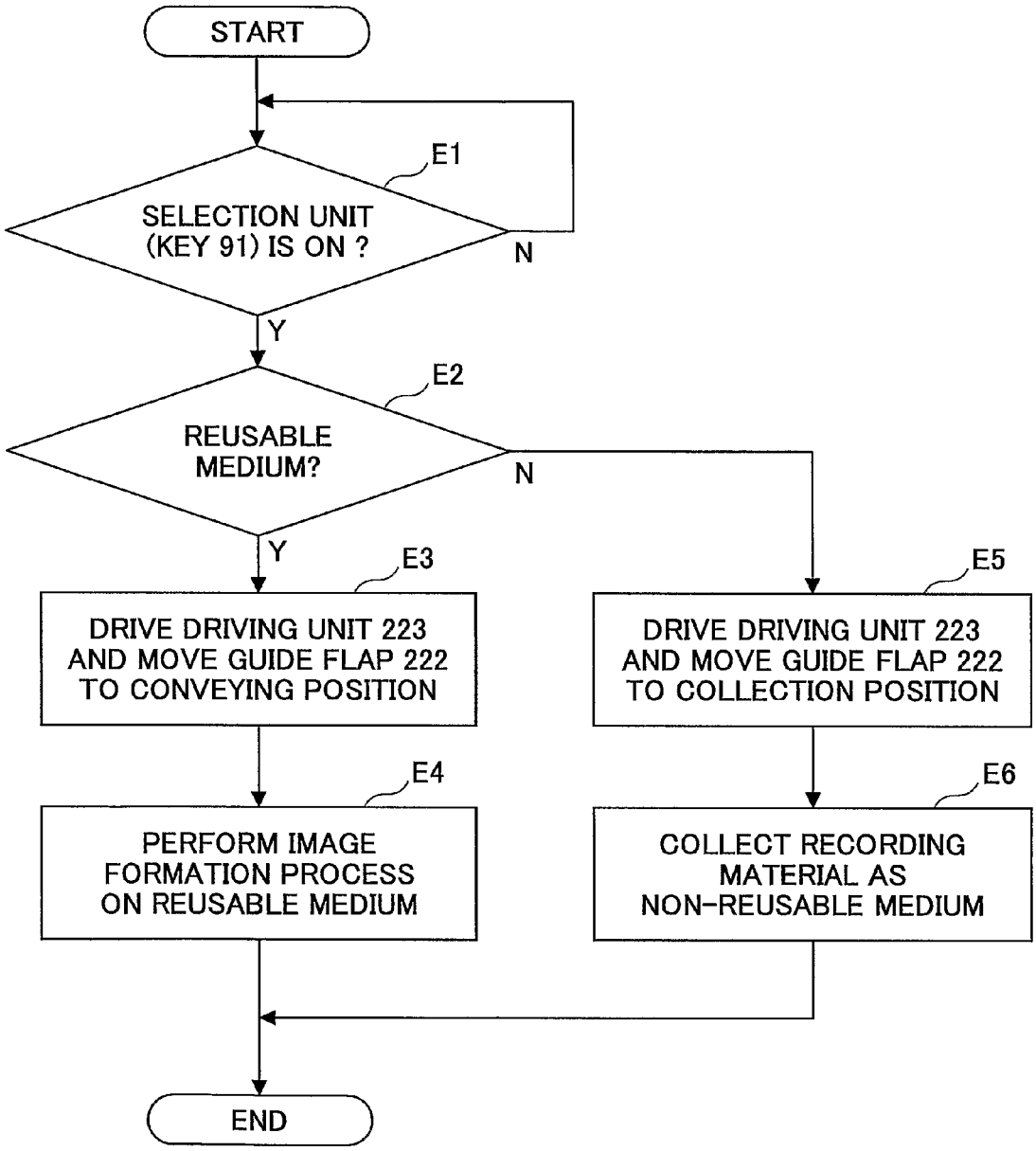
FIG. 10 is a flowchart showing another embodiment of control by a control unit.

In other words, in the control unit 80, as shown FIG. 10, when the key 91 is operated in step E1 so as to select the first image formation mode, a recording material is fed from the paper feed cassette 161*d*, and the sensor 181 detects the discrimination information indicating a reusable medium in step E2, the driving unit 223 shown in FIG. 3 is driven and the guide flap 222 is positioned at the conveying position in step E3, the recording material is conveyed to the image formation unit 1B, the toner powder images formed in the image formation operation are transferred in step E4, and the images are fixed using the fixation unit 140, thereby completing an image formation job.

On the other hand, if the discrimination information indicating a reusable medium is not detected on the recording material on which an image is to be formed by the sensor 181 in step E2, a signal of the sensor 181 is input to the control unit 80. Thereafter, an instruction for changing the conveying direction of the recording material is output from the control unit 80, the driving unit 223 shown in FIG. 3 is driven, and the guide flap 222 is positioned at the collection position in step E5. Thus, the image is not formed on the recording material and the recording material is ejected to the collection tray 164 through the pair of collection rollers 168 in step E6.

Another embodiment of control by the control unit 80 is described in the following.

Figure 11:
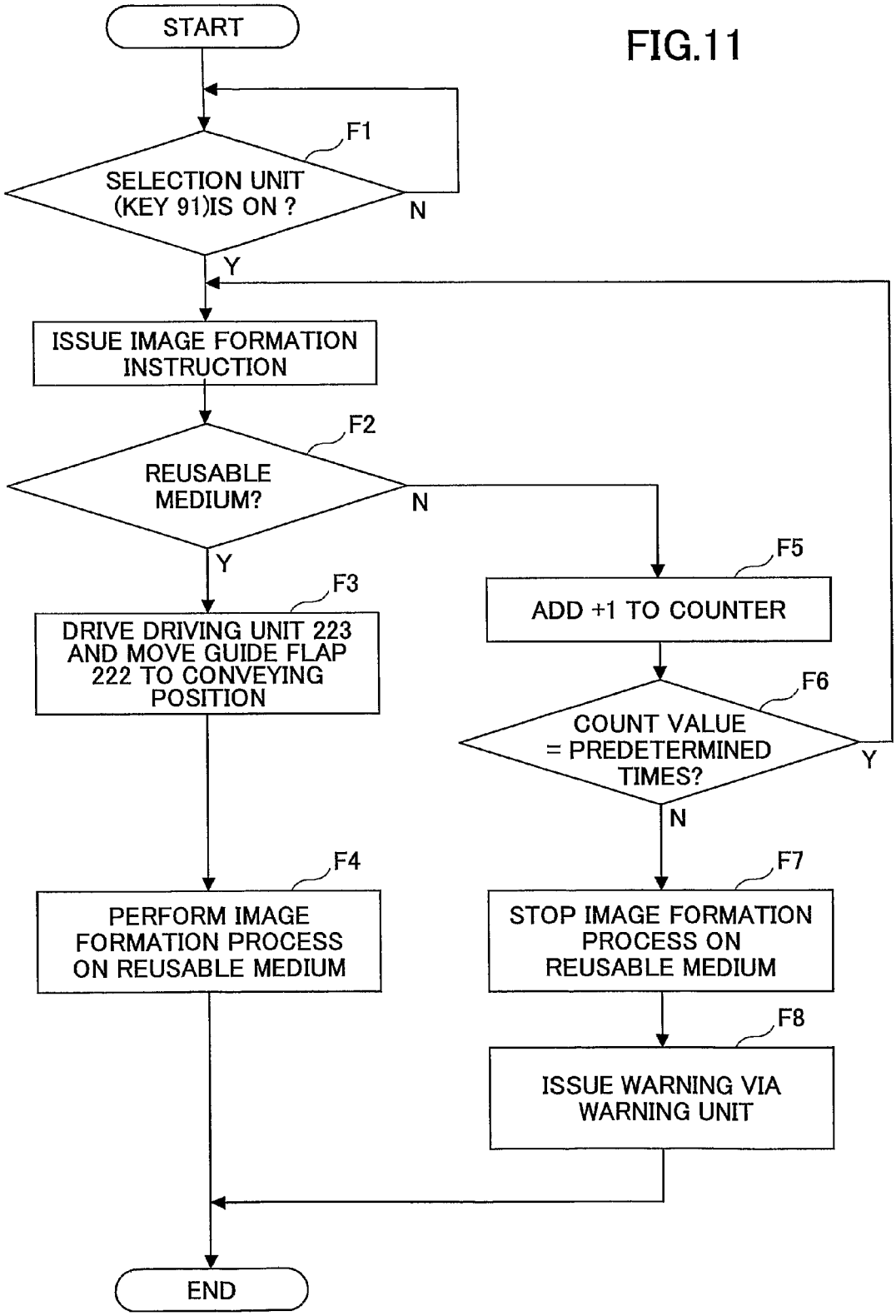
FIG. 11 is a flowchart showing another embodiment of control by a control unit.

As shown in a flowchart of FIG. 11, when the key 91 is operated in step F1 so as to select the first image formation mode and an image formation instruction for forming an image is issued thereafter, whether a recording material to be supplied is a reusable medium is judged in step F2. If the recording material is a reusable medium, in step F3, the driving unit 223 is driven, the guide flap 222 is positioned at the conveying position, and the recording material is conveyed to the image formation unit 1B. In step F4, the toner powder images formed in the image formation operation are transferred and the images are fixed using the fixation unit 140, thereby completing the image formation job.

On the other hand, in step F2, if the discrimination information indicating a reusable medium is not detected, the process proceeds to step F5 so as to add +1 to a counter not shown in the drawings and the process proceeds to step F6 so as to judge whether a count value reaches a predetermined times, namely, whether a predetermined number of sheets set in advance are successively counted. When the count value reaches the predetermined times since non-reusable media are successively counted, namely, when the discrimination information indicating a reusable medium is not detected for ten sheets successively, the process proceeds to step F7 so as to stop the image formation process and the process proceeds to step F8.

In step F8, the fact that image formation cannot be performed in the first image formation mode since reusable media are not supplied is notified to the user by operating the warning unit 230. In other words, the fact that inappropriate recording media are set is notified to the user.

The warning unit 230 may be a display disposed on the operation panel 231 or a user interface on a display connected to a computer issuing a printing instruction when the image formation apparatus is connected to the computer. Further, a form of warning may be voice, sound, lighting/flickering of a lamp and the like.

By controlling the image formation apparatus in this manner, even when the user erroneously mixes a general recording material in the paper feed cassette 161*d* where only those reusable media must be stored, if image information is used only for a short period of time, it is possible to securely record such information on the reusable medium and end the image formation operation without stopping the operation. Thus, it is possible to eliminate waste of recording materials and reduce environmental load. Moreover, it is possible to reduce a possibility that a general recording material on which an image is formed is mixed in the image removal device, prevent trouble such as generation of jam in the image removal device 2, and eliminate a loss of time resulting from stopping of the image formation operation.

The same operation is performed in a case where an image is formed in the second image formation mode. If the discrimination information indicating a reusable medium is detected by the sensor 181 on a recording material on which an image is to be formed, the driving unit 223 is driven and the guide flap 222 is positioned at the collection position, so that the image is not formed on the reusable medium and the reusable medium is ejected to the collection tray 164 via the pair of collection rollers 168. Then, the next recording material is supplied from the paper feed cassette in which a selected type of paper is set. If the discrimination information indicating a reusable medium is not detected by the sensor 181, the driving unit 223 is driven and the guide flap 222 is positioned at the conveying position, so that a general recording material is conveyed to the image formation unit, the toner powder images formed in the image formation operation is transferred, and the transferred images are fixed in the fixation unit 140, thereby completing the image formation job.

The same process as in the first image formation mode is performed if the discrimination information on the reusable medium is successively detected even when the second image formation mode is selected and an image formation instruction is issued. By controlling the image formation apparatus in this manner, even when the user erroneously mixes a reusable medium in the paper feed cassette where only those general recording materials must be stored, an image is not formed on the reusable medium and it is possible to securely record such information on the general recording material and end the image formation operation.

Thus, it is possible to prevent a stop of the image formation operation and eliminate a loss of time generated from printing only a specific page again. Further, it is possible to prevent mixing of the reusable medium and formal documents such as documents, contracts, and the like submitted to customers, government and public offices, outside companies, and outside divisions.

Another embodiment of control by the control unit 80 is described in the following.

When the image removal device 2 is installed on the image formation apparatus 1, the reusable medium used as a recording material from which a formed image is to be removed is usually stored in the paper feed cassette 161*d* as mentioned above, for example, and conveyed to the image removal device 2. When an image removal process is performed, the sensor 181 detects not only whether the recording material being conveyed has information for indicating a reusable medium but also the presence or absence of the discrimination information provided when the image is formed in the first image formation mode of the image formation apparatus 1.

If one of both set of information is not detected, the control unit 80 of the image formation apparatus judges that the image forming substances cannot be removed from the conveyed recording material and the control unit 80 is capable of positioning the guide flap 222 using the driving unit 223 such that the recording material is ejected to the collection tray 164. In other words, on the collection tray 164, a recording material inappropriate upon image formation is ejected and a recording material inappropriate upon image removal is ejected. The ejection of such inappropriate paper is caused by erroneous operation of the user and the like. Usually, a large number of recording materials are not ejected to the collection tray 164.

Upon image formation and image removal, preferably, the collection tray 164 to which the inappropriate recording materials are ejected is shared as mentioned above, so that it is possible to reduce the number of components, environmental load, and a cost.

Another embodiment of control by the control unit 80 is described in the following.

When the image removal device 2 is installed on the image formation apparatus 1, it is possible to perform the image formation operation and the image removal operation at the same time. However, as shown in FIG. 1, when the recording material conveying path 501 in which portions of the second conveying path 51 and the first conveying path 50 are shared is disposed, problems are generated in that control becomes difficult upon operation at the same time and electric consumption becomes excessively large, for example. Thus, the control unit 80 preferably controls such that the image formation operation and the image removal operation are not performed at the same time.

Figure 12:
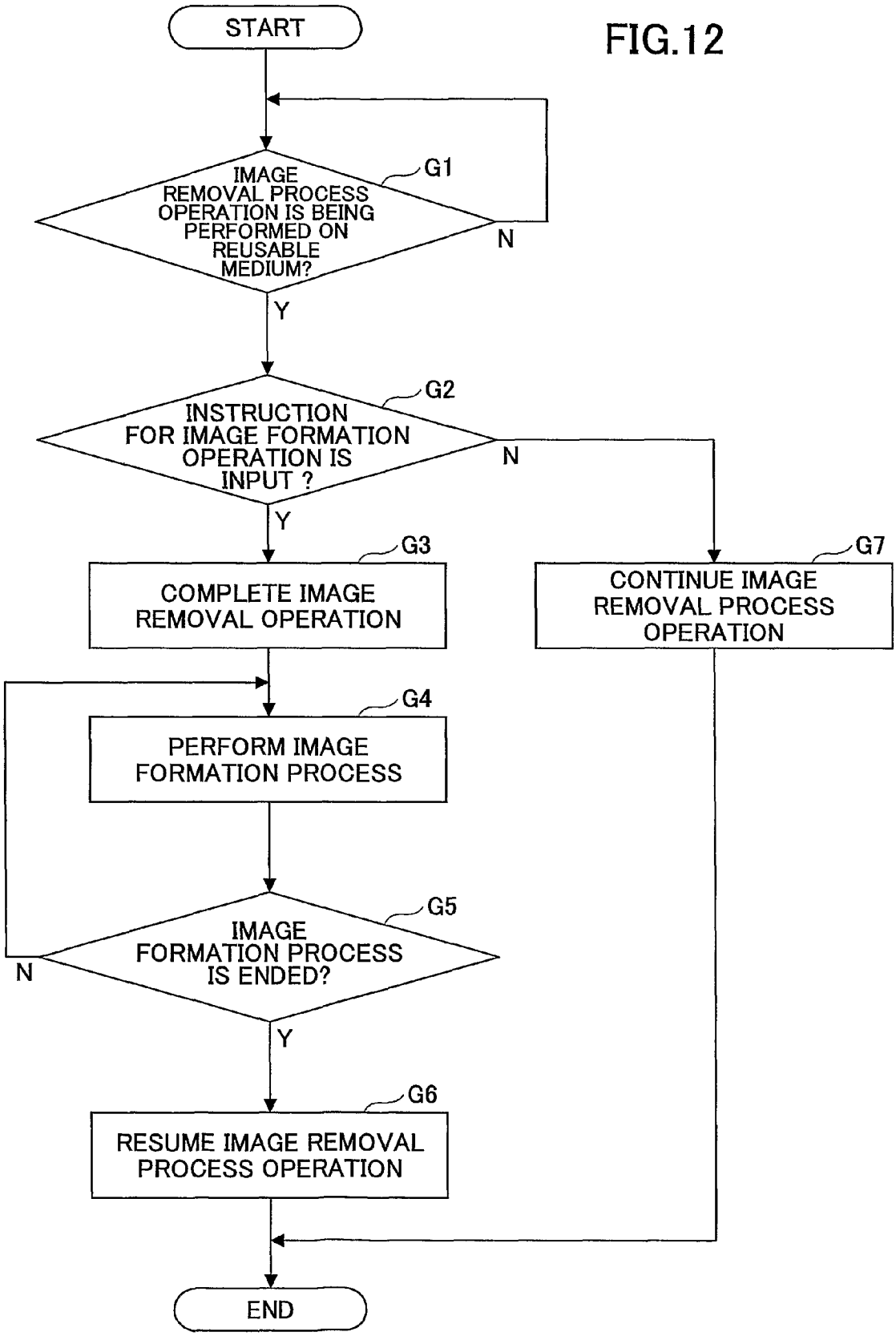
FIG. 12 is a flowchart showing another embodiment of control by a control unit.

In general, the image formation operation requires high speed and a ratio of actual period of time for the image formation operation to working hours at the offices is small. By contrast, normal image removal operation in which the reusable medium is conveyed from the paper feed cassette 161*d* does not require urgency in many cases. Accordingly, while a normal successive image removal process is being performed in which the reusable medium is conveyed from the paper feed cassette 161*d* as in step G1 shown in FIG. 12, if the user presses a print button 232 disposed on the operation panel 231 shown in FIG. 7 or an instruction for the image formation operation is input (step G2) by issuing a printing instruction from a driver of the user interface of the computer connected to the image formation apparatus via the network, for example, after the image removal process on the reusable medium ejected from the paper feed unit 161 is ended in step G3, the image formation process is preferentially performed immediately in step G4. Then, when an entire image formation operation is ended in step G5, it is possible to perform an interrupt control in step 6 such that the image removal process in operation is resumed. By contrast, even when the successive image removal process is being performed, if the instruction for the image formation operation is not input in step G2, the process proceeds to step G7 and the image removal process operation is continued.

By performing control in this manner, the user is capable of performing the image formation process and the process for removing an image from the reusable medium without reducing operational efficiency. Moreover, it is possible to prevent the electric consumption from becoming excessively large resulting from performing the image formation process and the image removal process at the same time. Further, it is possible to simplify control operation and the control unit 80.

Another embodiment of control by the control unit 80 is described in the following.

The process for removing an image from the reusable medium is controlled to be automatically continued while the reusable medium is present in the dedicated paper feed cassette 161*d*. The process for removing an image from the reusable medium is performed not only on the reusable medium fed from the paper feed cassette 161*d* but also on the reusable medium fed from the manual paper feed tray 162. The process for removing an image from the reusable medium fed from the manual paper feed tray 162 is performed only through an image removal process start button 233 disposed on the operation panel 231 shown in FIG. 7. The image removal process on the reusable medium fed from the manual paper feed tray 162 is given priority over any image formation process operation and the image removal process on the reusable medium fed from the paper feed cassette 161*d*.

Figure 13:
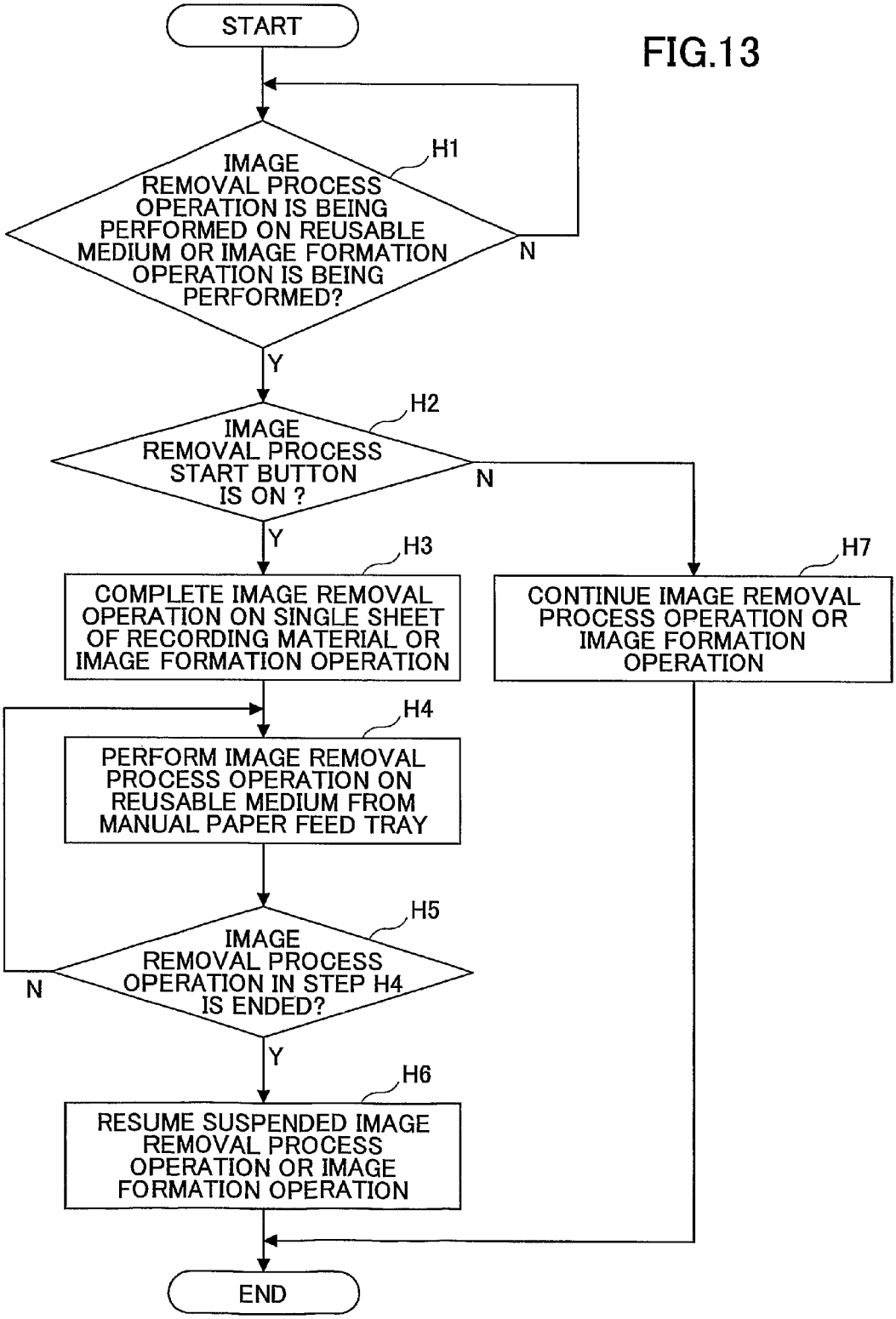
FIG. 13 is a flowchart showing another embodiment of control by a control unit.

In step H1 shown in FIG. 13, while a normal successive image removal process is being performed in which the reusable medium is conveyed from the paper feed cassette 161*d*, if the image removal process start button 233 is turned on in step H2, for example, after the process on a single sheet of the reusable medium ejected from the paper feed unit 161 is ended in step H3, the process operation for removing an image is immediately performed on the reusable medium fed from the manual paper feed tray 162 in step H4. This operation is given priority until the reusable medium from the manual paper feed tray 162 runs out. When the image removal process is ended in H5, an interrupt control is performed in step H6 such that the image removal process or the image formation process in operation is resumed.

In this manner, by performing control such that the process for removing an image from the reusable medium fed from the manual paper feed tray 162 is given priority over any operation, the user is capable of removing image information on the reusable medium in which especially highly-confidential information is recorded without allowing many persons to see the image information and is capable of confirming whether the information is securely removed. In other words, it is possible to use the image removal device 2 connected to the image formation apparatus so as to protect confidentiality in the same manner as a shredder and reuse the reusable medium.

Another embodiment of control by the control unit 80 is described in the following.

In the image removal device 2 shown in FIG. 1, a sensor 182 is disposed on the third conveying path 52. The sensor 182 is a detection unit detecting whether there is a remaining image on the reusable medium used as a recording material from which an image is removed. The sensor 182 is disposed based on the fact that an image may remain on the reusable medium after the image removal process when writing is performed using writing materials incapable of removal by the image removal process or when a number of reuse of the reusable medium becomes large and an image is incompletely removed.

Figure 14:
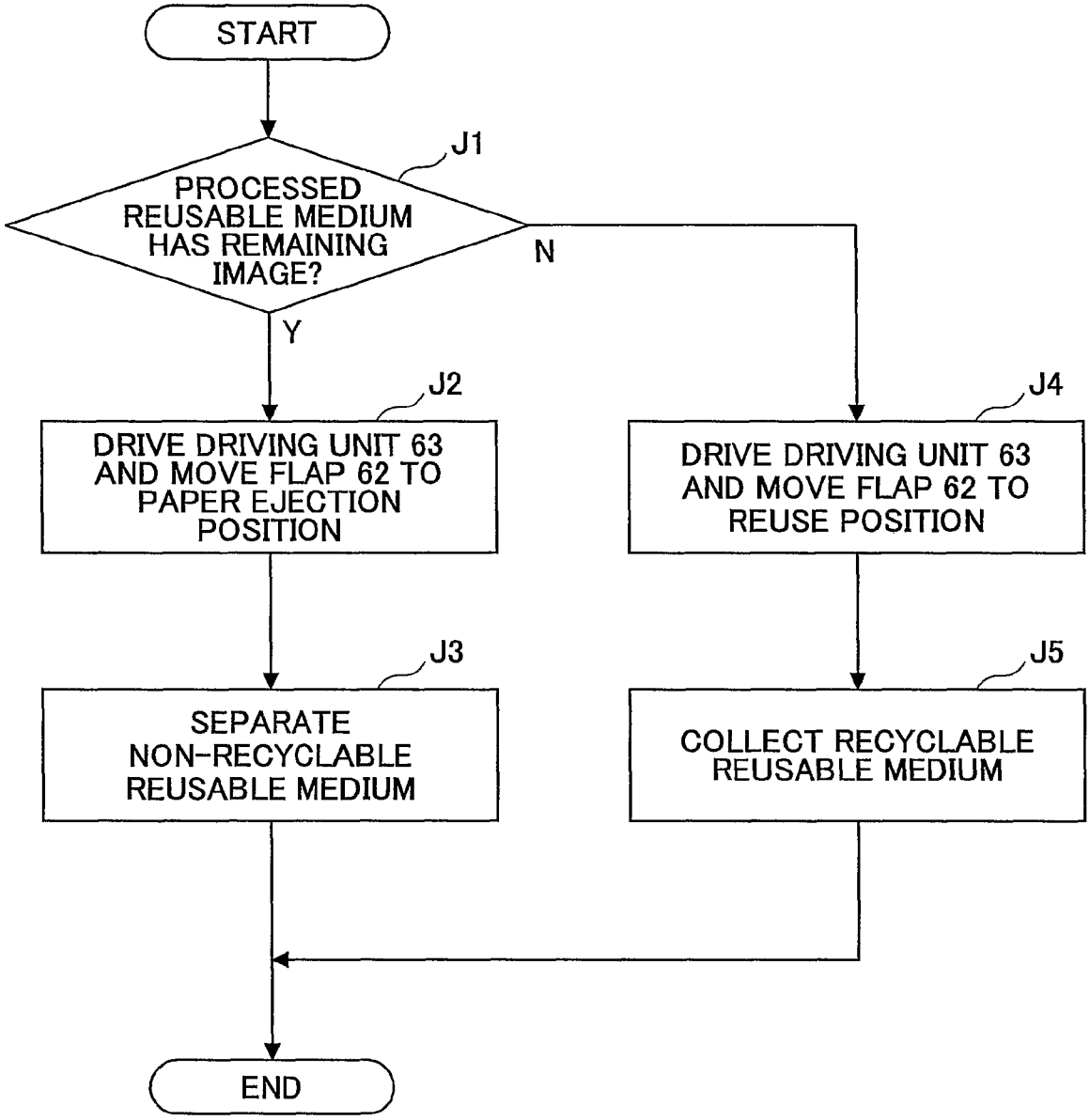
FIG. 14 is a flowchart showing another embodiment of control by a control unit.

It is possible to construct the sensor 182 using a line image sensor including a CCD. As shown in FIG. 14, for example, in step J1, the presence or absence of a remaining image on the reusable medium after the image removal process is judged based on an output from the sensor 182. If the remaining image is judged to be present, the driving unit 63 is driven and the flap 62 is moved to the paper ejection position in step J2, so that the reusable medium having the remaining image is returned to the first conveying path 50 and the reusable medium is ejected to the paper ejection tray 163 as a non-reusable medium via a pair of conveying rollers 185*e*, the fixing roller 141, the pair of conveying rollers 170*g*, and the pair of paper ejection rollers 167 in step J3, without ejecting the reusable medium to the medium ejection tray 165. On the other hand, if the remaining image is judged to be absent in step J1, the driving unit 63 is driven and the flap 62 is moved to the reuse position in step J4 and the reusable medium is ejected to the medium ejection tray 165 as a reusable media in step J5.

As mentioned above, the image formation process and the image removal process are not performed at the same time, so that the reusable medium having the remaining image after the image removal process is not inserted between recording materials on which an image is formed at a single image formation instruction.

Figure 15:
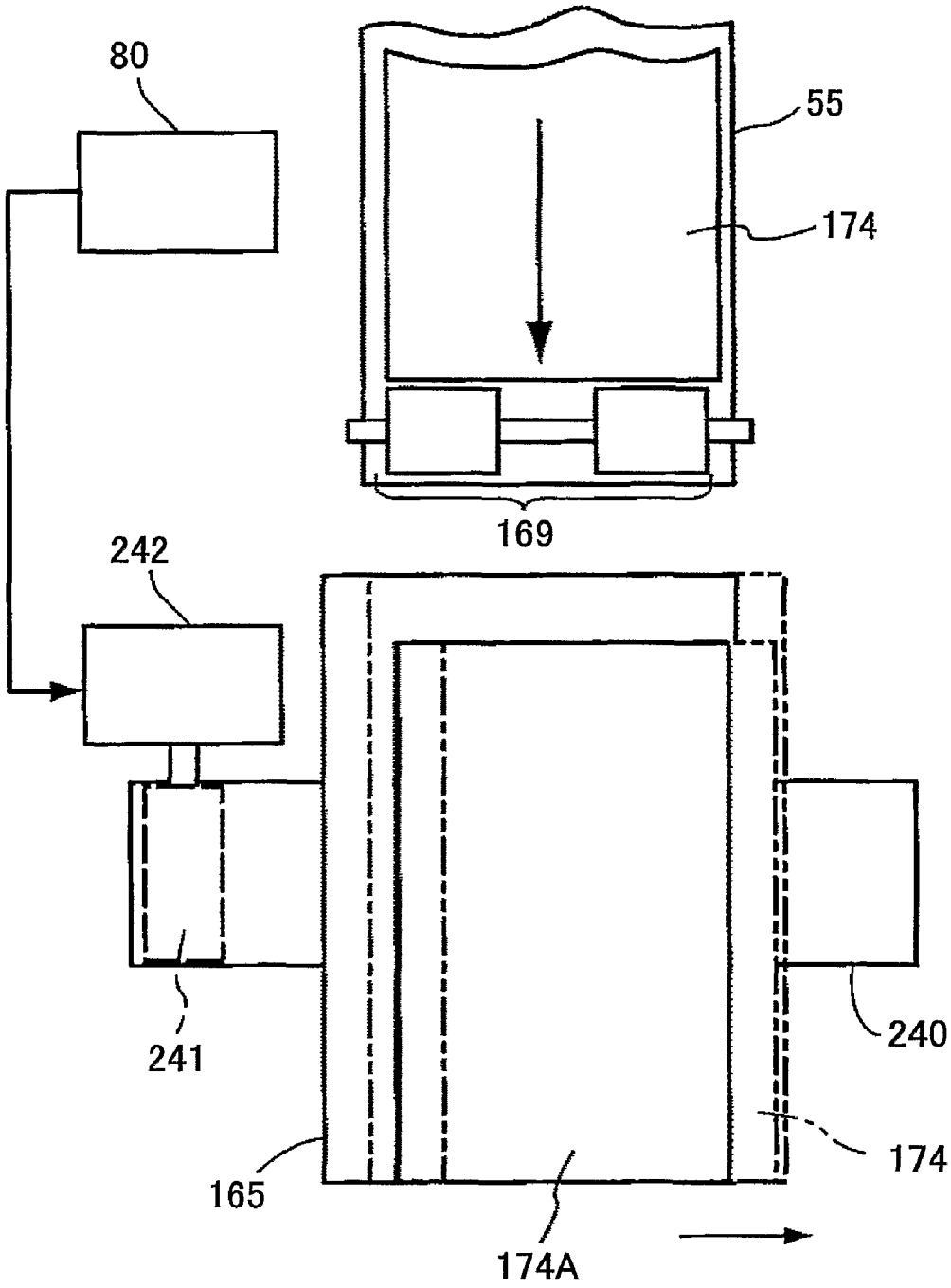
FIG. 15 is a plan view showing an embodiment of a mechanism as a media separation unit.

When a multi-stage paper ejection device such as a conventional sorter is installed on the image formation apparatus 1, the reusable medium having the remaining image after the image removal process may be controlled to be ejected to other bin separate from the recording material on which an image is formed based on the image formation instruction. Or, as shown in FIG. 15, a rack 240 may be disposed in a movement direction of the medium ejection tray 165 and a driving motor 242 may be disposed on the housing B of the image removal device 2, the driving motor 242 rotating a pinion gear 241 meshing with the rack 240 by a certain angle. Then, the reusable medium having the remaining image after the image removal process is ejected to the medium ejection tray 165 in the same manner as the reusable medium having no remaining image. When ejecting the reusable medium having the remaining image, by driving the driving motor 242 and shifting the medium ejection tray 165 in a direction orthogonal relative to a paper conveying direction, the reusable medium may be controlled to be stocked such that the reusable medium 174 from which an image is completely removed and a reusable medium 174A having the remaining image are readily separated.

The above-mentioned description is based on the assumption that the image removal device 2 is installed on the image formation apparatus 1. However, the user may not require the reuse of the recording material using the reusable medium. Further, although plural image formation apparatuses 1 are required, the image removal device 2 may not necessarily be connected to each of the image formation apparatuses 1. Moreover, the installed image removal device 2 may become no longer necessary and the user may wish to detach the image removal device 2. In a case where the image removal device 2 is not installed, by having a common structure for the image formation apparatus 1 and allowing the image removal device 2 to be detachably installed, it is possible to install and detach the image removal device 2 as appropriate and add the image removal function so as to meet user demands and to simplify the structure of the image removal device 2 and reduce environmental load and a cost.

In particular, as in the present invention, it is possible to simplify the structure of the image removal device 2 installed on the image formation apparatus 1 by sharing the paper feed unit of the recording material such as the paper feed cassette, the manual paper feed unit, the conveying path, and the sensor 181 used as a recognition unit for the discrimination information between the image formation apparatus 1 and the image removal device 2, and disposing the control unit 80 controlling an entire portion on the image formation apparatus 1 when the image removal device 2 is installed on the image formation apparatus 1.

Further, the image formation apparatus 1 and the image removal device 2 are not operated at the same time, so that it is possible to share a driving system, a direct-current power supply, and the like of the image formation apparatus 1 and the image removal device 2 between the image formation apparatus and the image removal device and to use such elements through switching with a clutch or a switch. However, those users wishing to have the image formation apparatus 1 and the image removal device 2 from the beginning may be provided with an image formation apparatus in which the image formation function and the image removal function are stored in a single housing A.

Figure 16:
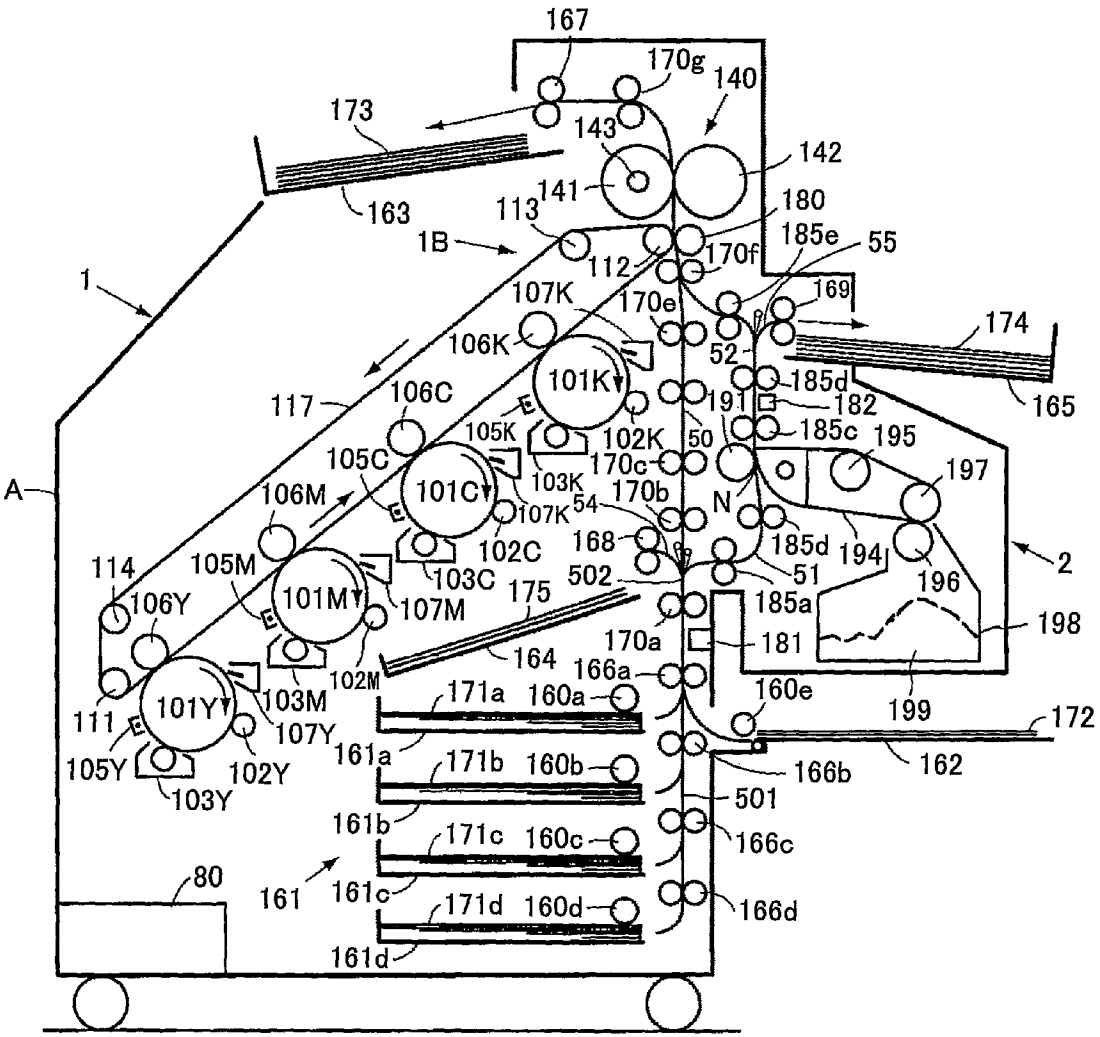
FIG. 16 is a schematic diagram showing another embodiment of an image formation apparatus integrally including an image removal device.

In other words, as shown in FIG. 16, the image formation apparatus may include the image formation unit to which the recording material is supplied at least from the manual paper feed tray 162, the image removal device 2 disposed on the housing A and removing an image recorded on the recording material, and the switch unit 210 switching whether the recording material fed from the manual paper feed tray 162 is supplied to the image removal device or the image formation unit.

In the above-mentioned image formation unit, a technique for forming an image by the most common electrophotography is employed as an image formation method in which an electrostatic latent image is formed on each of photoconductors, development is performed using dry toner, and toner powder images are transferred to the recording material. However, the present invention is not limited to this and electrophotography such as an electrostatic recording method, toner jet recording method, ion flow printing, and the like may be used where photoconductors are not used.

Further, the image formation method is not necessarily limited to electrophotography but includes a magnetic recording process in which thermoplastic image forming substances are used for image formation and a thermal transfer method. When an image is formed by an ink-jet method using thermofusible solid ink, it is possible to remove the image forming substances by thermally transferring the substances to the image peeling member and apply the present invention to an image formation apparatus using these image formation methods.

Moreover, as clearly understood from the principle of the present invention, it is possible to apply the present invention to methods for removing an image from the recording material even when the image is not thermally transferred to the image peeling member. For example, such image removal methods may include a method for washing out an image using water, organic solvent, and the like, a method for removing the image by scraping, and a method for eliminating colors of coloring materials using heat, light irradiation, and the like.

In the embodiments, the reusable medium is described as a recording material to which an agent having repellency to image forming substance is provided so as to reduce adhesion to the image forming substances. However, recording materials in which a substance swelling with water and the like is provided and adhesion to the image forming substances is reduced when a separation solution such as water is provided may be used as the reusable medium. Also, it is possible to use recording materials in which resin having resistance of abrasion such as UV-curable resin is coated and image forming substances can be scraped off from a surface as the reusable medium and to use recording materials in which compounds for eliminating color of image forming substances through a chemical reaction with the image forming substances are provided as the reusable medium. When these recording materials are used, an image removal device capable of performing image removal for each reusable medium may be used.

Although the manual paper feed tray 162 installed on the image formation apparatus 1 is configured to be shared, a paper feed cassette dedicated to reusable medium may be disposed on the manual paper feed tray 162 on the image removal device 2.

The present invention is not limited to the specifically disclosed embodiment, and variations and modifications may be made without departing from the scope of the present invention.

The present application is based on Japanese priority application No. 2006-206659 filed Jul. 28, 2006, the entire contents of which are hereby incorporated herein by reference.

The invention claimed is:

1. An image formation apparatus, comprising:

a manual paper feed unit to supply a recording material;

an image formation unit to receive the recording material from said manual paper feed unit;

an installation unit to detachably install, on the image formation apparatus, an image removal device that is configured to remove an image recorded on the recording material; and a switching unit to switch whether the recording material fed from said manual paper feed unit is supplied to the image removal device installed using said installation unit or to said image formation unit.

2. The image formation apparatus according to claim 1, wherein the recording material includes a reusable medium from which an image formed thereon can be removed by said image removal device and a general recording material from which an image formed thereon can not be removed by said image removal device.

3. The image formation apparatus according to claim 2, wherein the reusable medium includes a recording material to which at least one agent having repellency to an image forming substance is provided so as to reduce fixation of the image forming substance.

4. The image formation apparatus according to claim 2, further comprising:

a first paper feed cassette storing the reusable medium; and a second paper feed cassette storing the general recording material.

5. The image formation apparatus according to claim 2, further comprising:

a selection unit configured to allow a user to select a first image formation mode for forming an image on the reusable medium and a second image formation mode for forming the image on the general recording material; and a control unit configured to perform control so as to form the image on the reusable medium when the first image formation mode is selected and to form the image on the general recording material when the second image formation mode is selected using said selection unit.

6. The image formation apparatus according to claim 5, wherein the reusable medium has discrimination information for recognizing reusability of the reusable medium, and a first conveying path for supplying the recording material to said image formation unit and a second conveying path for supplying the recording material to said image removal device partially share a common path for conveying the recording material, the image formation apparatus further comprising:

a recognition unit configured to judge the discrimination information of the reusable medium, the recognition unit being disposed on said common path for conveying the recording material.

7. The image formation apparatus according to claim 6, wherein an image is formed in said image formation unit when a recording material appropriate for an image formation mode is detected before recording materials inappropriate for the image formation mode selected using said selection unit are successively detected for a predetermined number of times, an image formation operation by said image formation unit is stopped when inappropriate recording materials are successively detected for the predetermined number of times, and ejection is performed without performing the image formation operation when inappropriate recording materials are successively detected for less than the predetermined number of times.

8. The image formation apparatus according to claim 6, including:

a warning unit configured to output warning information for notifying that an inappropriate recording material is set when inappropriate recording materials are successively detected by said recognition unit for a predetermined number of times.

9. The image formation apparatus according to claim 6, wherein the discrimination information in the reusable medium includes discrimination information recorded in an IC chip disposed on the reusable medium in an integrated manner.

10. The image formation apparatus according to claim 1, wherein after said image removal device is installed on said image formation apparatus, even when an image removal process operation is being performed successively by said image removal device, if an image formation instruction is input, the image removal process operation is suspended and an image formation operation is preferentially performed, and then after the image formation operation is ended, the image removal process operation is resumed.

11. The image formation apparatus according to claim 1, wherein after said image removal device is installed on said image formation apparatus, even when an image removal process operation is being performed on a recording material by said image removal device, the recording material being conveyed from a paper feed cassette disposed on said image formation apparatus or said image removal device, if an image removal process instruction is input for a recording material supplied from said manual paper feed unit, the image removal process operation on the recording material conveyed from said paper feed cassette is suspended and an image removal process operation on the recording material conveyed from said manual paper feed unit is preferentially performed, and then after the image removal process operation is ended, the image removal process operation on the recording material conveyed from said paper feed cassette is successively resumed.

12. The image formation apparatus according to claim 1, further comprising:

a control unit configured to perform an interrupt control, wherein after said image removal device is installed on said image formation apparatus, even when an image formation operation is being performed successively or an image removal process operation is being performed successively on a recording material by said image removal device, the recording material being conveyed from a paper feed cassette disposed on said image formation apparatus or said image removal device, if an image removal process instruction is input for a recording material supplied from said manual paper feed unit, the image formation operation or the image removal process operation on the recording material conveyed from said paper feed cassette is temporarily suspended and an image removal process operation on the recording material conveyed from said manual paper feed unit is preferentially performed, and then after the image removal process operation is ended, the suspended image formation operation or the image removal process operation on the recording material conveyed from said paper feed cassette is resumed.

* * * * *